US010962240B2

(12) United States Patent
Ogawa et al.

(10) Patent No.: US 10,962,240 B2
(45) Date of Patent: Mar. 30, 2021

(54) OUTDOOR UNIT FOR AIR CONDITIONING DEVICE

(71) Applicant: Mitsubishi Electric Corporation, Tokyo (JP)

(72) Inventors: Mizuki Ogawa, Tokyo (JP); Toshiya Fuse, Tokyo (JP); Motoki Otsuka, Tokyo (JP); Ryutaro Kawasaki, Tokyo (JP); Shingo Koseki, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 120 days.

(21) Appl. No.: 16/323,581

(22) PCT Filed: Oct. 13, 2017

(86) PCT No.: PCT/JP2017/037159
§ 371 (c)(1),
(2) Date: Feb. 6, 2019

(87) PCT Pub. No.: WO2018/074354
PCT Pub. Date: Apr. 26, 2018

(65) Prior Publication Data

US 2020/0088422 A1 Mar. 19, 2020

(30) Foreign Application Priority Data

Oct. 17, 2016 (JP) ..... JP2016-203656

(51) Int. Cl.
*F24F 1/58* (2011.01)
*F24F 1/16* (2011.01)
(Continued)

(52) U.S. Cl.
CPC ..... *F24F 1/58* (2013.01); *F24F 1/16* (2013.01); *F24F 1/18* (2013.01); *F24F 1/34* (2013.01);
(Continued)

(58) Field of Classification Search
CPC ..... F24F 1/16; F24F 1/18; F24F 1/34; F24F 1/58; F24F 1/20; F24F 1/30; F24F 1/38
See application file for complete search history.

(56) References Cited

U.S. PATENT DOCUMENTS

2014/0131019 A1* 5/2014 Kagawa ..... F25D 23/00 165/121
2017/0370597 A1* 12/2017 Kaneda ..... F24F 1/34

FOREIGN PATENT DOCUMENTS

JP 2013137127 A 7/2013
JP 2016084994 A 5/2016

OTHER PUBLICATIONS

International Search Report (PCT/ISA/210) dated Dec. 12, 2017, by the Japan Patent Office as the International Searching Authority for International Application No. PCT/JP2017/037159.
(Continued)

*Primary Examiner* — Marc E Norman
*Assistant Examiner* — Schyler S Sanks
(74) *Attorney, Agent, or Firm* — Buchanan Ingersoll & Rooney PC

(57) ABSTRACT

An outdoor unit for an air conditioning device includes a heat exchanger including (i) heat transfer tubes arranged with a space therebetween and each having one end connected to a refrigerant tube, and (ii) fins extending from the heat transfer tubes; first and second protective members each having (i) a flat plate that covers a respective end portion of the heat transfer tubes and an endmost fin that is located nearest the end portions of the heat transfer tubes, and (ii) a protrusion that protrudes from the flat plate toward the space between the heat transfer tubes near the end portions of the heat transfer tubes; first and second cover members that cover a respective flat plate; and a housing having an inner
(Continued)

wall abutting the first cover member and an inner wall abutting the second cover member.

12 Claims, 33 Drawing Sheets

(51) Int. Cl.

| | |
|---|---|
| ***F24F 1/18*** | (2011.01) |
| ***F24F 1/34*** | (2011.01) |
| ***F24F 1/20*** | (2011.01) |
| ***F24F 1/30*** | (2011.01) |
| ***F24F 1/38*** | (2011.01) |

(52) U.S. Cl.
CPC . *F24F 1/20* (2013.01); *F24F 1/30* (2013.01); *F24F 1/38* (2013.01)

(56) References Cited

OTHER PUBLICATIONS

Written Opinion (PCT/ISA/237) dated Dec. 12, 2017, by the Japan Patent Office as the International Searching Authority for International Application No. PCT/JP2017/037159.

* cited by examiner

OUTDOOR UNIT FOR AIR CONDITIONING DEVICE

TECHNICAL FIELD

The present disclosure relates to an outdoor unit for an air conditioning device.

BACKGROUND ART

Outdoor units for air conditioning devices include a type of outdoor unit having a heat exchanger that includes heat transfer tubes provided with fins and a housing that houses the heat exchanger. The heat transfer tubes of the heat exchanger are disposed in parallel to one another and connected to refrigerant tubes at end portions of the heat transfer tubes.

In typical manufacture of a heat exchanger, heat transfer tubes are press-fit to and integrated with the fins by brazing, and then the heat transfer tubes integrated with the fins are bent. Variations in temperature distribution in the brazing process, dimensions or materials of the fins and the heat transfer tubes, and other factors may result in warpage or dimensional variations in the heat exchanger. Such warpage or dimensional variations may cause a gap between the heat exchanger and the housing in installation of the heat exchanger in the housing of the outdoor unit. To address this, various techniques have been developed to prevent deformation of the heat exchanger or cover the gap between the heat exchanger and the housing.

For example, Patent Literature 1 discloses an outdoor unit including a heat exchanger, enclosing members, and a housing, wherein the heat exchanger includes vertically-arranged heat transfer tubes and refrigerant tubes connected to end portions of the respective heat transfer tubes, the enclosing members cover connections between the refrigerant tubes and the end portions of the heat transfer tubes, and the housing has inner walls on which the enclosing members are fastened. Each enclosing member has a first side plate with openings through which the heat transfer tubes pass and a second side plate to be fastened on the inner wall of the housing. The first side plate encloses spaces between the heat transfer tubes, and the second side plate fills a gap between the heat transfer tubes and the housing.

Patent Literature 2 discloses an outdoor unit including a heat exchanger and two support members, wherein the heat exchanger includes vertically-arranged heat transfer tubes and refrigerant tubes each connected to end portions of the heat transfer tubes, and the two support members sandwich the end portions of the heat transfer tubes and refrigerant tubes connected to the end portions therebetween. In Patent Literature 2, the two support members correct warpage of the heat exchanger, thereby reducing deformation of the heat exchanger.

CITATION LIST

Patent Literature

Patent Literature 1: Unexamined Japanese Patent Application Kokai

Publication No. 2013-137127

Patent Literature 2: Unexamined Japanese Patent Application Kokai Publication No. 2016-84994

SUMMARY OF INVENTION

Technical Problem

In the outdoor unit of Patent Literature 1, however, gaps can occur between the enclosing member and the heat transfer tubes due to deformation of the enclosing member when warpage of the heat exchanger occurs. This gap may permit entry of rainwater entrained with outside air into a space enclosed by the enclosing member. The rainwater having entered the space enclosed by the enclosing member may spread, which may cause attachment of droplets to electrical components inside the housing.

In the outdoor unit of Patent Literature 2, each fin has grooves formed between portions of the fin. The support members abut tips of the fins. The support members, however, do not enclose the grooves. Thus this outdoor unit may permit inflow of the outside air through a space in the grooves. Rainwater entrained in the inflow air may spread inside the housing, which may cause attachment of spread rainwater to electrical components inside the housing.

Such attachment of rainwater to the electrical components may hasten deterioration and cause problems such as short circuits.

In view of the above disadvantages, an objective of the present disclosure is to provide an outdoor unit for an air conditioning device that can reduce attachment of rainwater to electrical components due to spreading of the rainwater inside the housing.

Solution to Problem

To achieve the above objective, an outdoor unit for an air conditioning device according to the present disclosure includes a heat exchanger, a first protective member, a second protective member, a first cover member, a second cover member, and a housing that houses the heat exchanger, the first protective member, the second protective member, the first cover member, and the second cover member. The heat exchanger includes heat transfer tubes arranged with a space provided therebetween and fins extending from the heat transfer tubes. The heat transfer tubes each have one end connected to a refrigerant tube, which allows heat of refrigerant contained in the refrigerant tubes to be transferred through the heat transfer tubes. The fins serve to exchange heat between the heat transfer tubes and the outside air. The first protective member has (i) a first flat plate that covers one-end portions of the heat transfer tubes and an endmost fin that is located nearest the one-end portions of the heat transfer tubes, and (ii) a first protrusion that protrudes from the first flat plate toward the space between the heat transfer tubes near the one-end portions of the heat transfer tubes. The second protective member has (i) a second flat plate that covers one-end portions of the heat transfer tubes and the endmost fin oppositely from the first flat plate, and (ii) a second protrusion that protrudes from the second flat plate toward the space near the one-end portions of the heat transfer tubes. The first cover member covers the first flat plate and the second cover member covers the second flat plate. The housing has an inner wall abutting the first cover member and an inner wall abutting the second cover member.

Advantageous Effects of Invention

According to the configuration of the present disclosure, the one-end portions of the heat transfer tubes and the endmost fin are sandwiched between the first flat plate and the second flat plate, and the first protrusion and the second protrusion protrude toward the space near the one-end portions of the heat transfer tube, thereby enclosing the space between one-end portions of the heat transfer tubes. The inner walls of the housing abut the first cover member and the second cover member, thereby filling the gap between the inner wall of the housing and the first cover member and the gap between the inner wall of the housing and the second cover member. This can reduce entry of rainwater from an area near the one-end portions of the heat transfer tubes, thereby reducing spreading of the rainwater inside the housing. Consequently, attachment of rainwater to electrical components by spreading can be reduced.

DESCRIPTION OF EMBODIMENTS

Figure 1:
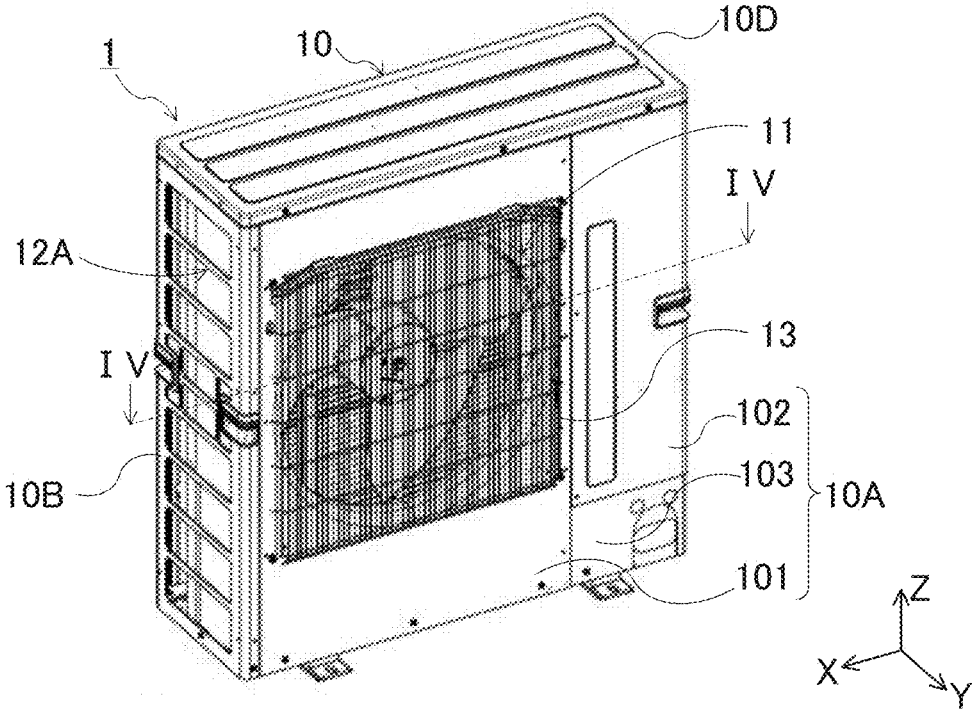
FIG. 1 is a front perspective view illustrating an outdoor unit for an air conditioning device according to Embodiment 1 of the present disclosure.

An outdoor unit for an air conditioning device according to embodiments of the present disclosure is described below in detail with reference to the drawings. The same reference signs are used to refer to the same or like parts throughout the drawings. An orthogonal coordinate system XYZ in the drawings indicates directions of the outdoor unit when an air discharge vent side of the outdoor unit is taken as a front side of the outdoor unit; specifically, the X axis indicates a left-right direction, the Z axis indicates an up-down direction, and the Y axis indicates a direction perpendicular to the X and Z axes. This coordinate system is used as appropriate in the following description.

Embodiment 1

An outdoor unit for an air conditioning device according to Embodiment 1 includes a fan, a heat exchanger, and a housing that houses the fan and the heat exchanger. The configuration of the outdoor unit for the air conditioning device is described below with reference to FIGS. 1 to 30. The housing is firstly described, followed by the description of the structure of the housing interior.

Figure 2:
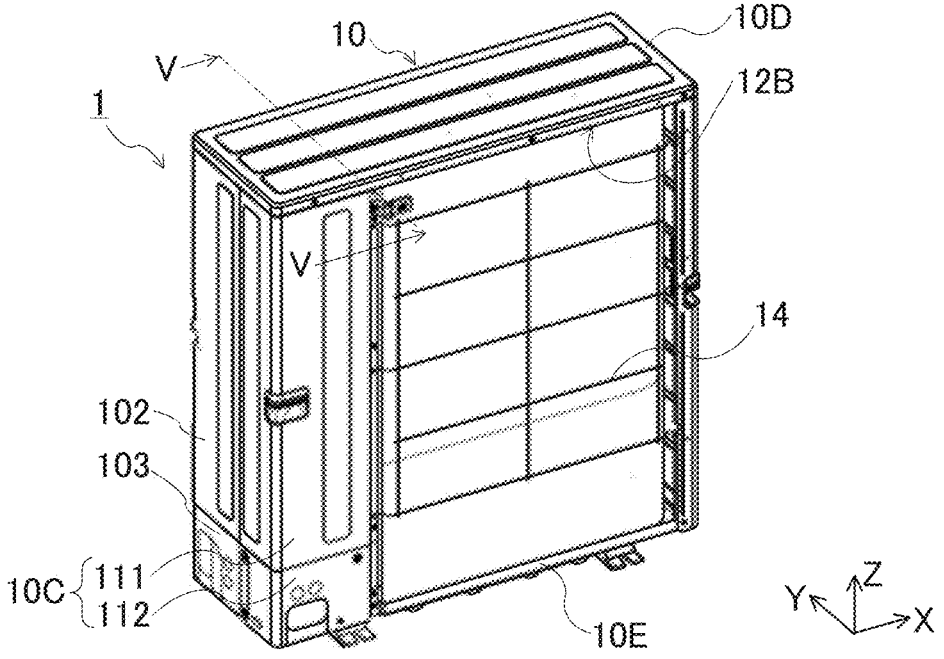
FIG. 2 is a rear perspective view of the outdoor unit.

FIG. 1 is a front perspective view illustrating the outdoor unit for the air conditioning device according to Embodiment 1 of the present disclosure. FIG. 2 is a rear perspective view of the outdoor unit.

The outdoor unit 1 includes a housing 10 having a rectangular parallelepiped shape, as illustrated in FIGS. 1 and 2. The housing 10 includes a front panel 10A, a left side panel 10B, a rear panel 10C, a top panel 10D, and a bottom panel 10E. The front panel 10A forms a +Y-side (front side) outer wall, the left side panel 10B forms a +X-side (left side when viewed from the front) outer wall, the rear panel 10C forms a −Y-side (rear side) outer wall, the top panel 10D forms a +Z-side (top side) outer wall, and the bottom panel 10E forms a −Z-side (bottom side) outer wall. The front panel 10A and the rear panel 10C are shaped to have a bent portion on the −X ends to also form a −X-side (right side when viewed from the front) outer wall of the housing 10.

The front panel 10A includes a first front panel section 101 that forms most of the front-side outer wall of the outdoor unit 1, a second front panel section 102 that forms an upper right portion of the front-side outer wall and a portion of the right-side outer wall, and a third front panel section 103 that forms an lower right portion of the front-side outer wall and a portion of the right-side outer wall. The first front panel section 101 has an air discharge vent 11. The first front panel section 101 is provided with a fan guard 13 that covers the air discharge vent 11 to provide enhanced safety.

The rear panel 10C includes (i) a first rear panel section 111 that forms a portion of the rear-side outer wall and a portion of the right-side outer wall (illustrated on the left side in FIG. 2) of the outdoor unit 1 and (ii) a second rear panel section 112 that forms another portion of the rear-side outer wall and another portion of the right-side outer wall. A +X-side area (right area when viewed from the rear) of the rear-side outer wall is not covered with the panel, and this area serves as an air inlet 12B. The area is covered with a rear guard 14. The left side panel 10B has an air inlet 12A having a plurality of openings.

The air inlets 12A and 12B and the air discharge vent 11 of the housing 10 as described above may permit entry of rainwater into the housing 10 when the outdoor unit 1 is installed outdoors. Such entry may lead to spreading of the rainwater inside the housing 10, which may cause attachment of droplets to electrical components inside the housing 10. To reduce attachment of rainwater to the electrical components due to the spreading inside the housing 10, the housing 10 is provided therein with a separator plate 10F for partitioning the housing 10 into a space that permits entry of rainwater and a space that does not permit the entry. The structure of the housing 10 interior is next described with reference to FIGS. 3 and 4.

Figure 3:
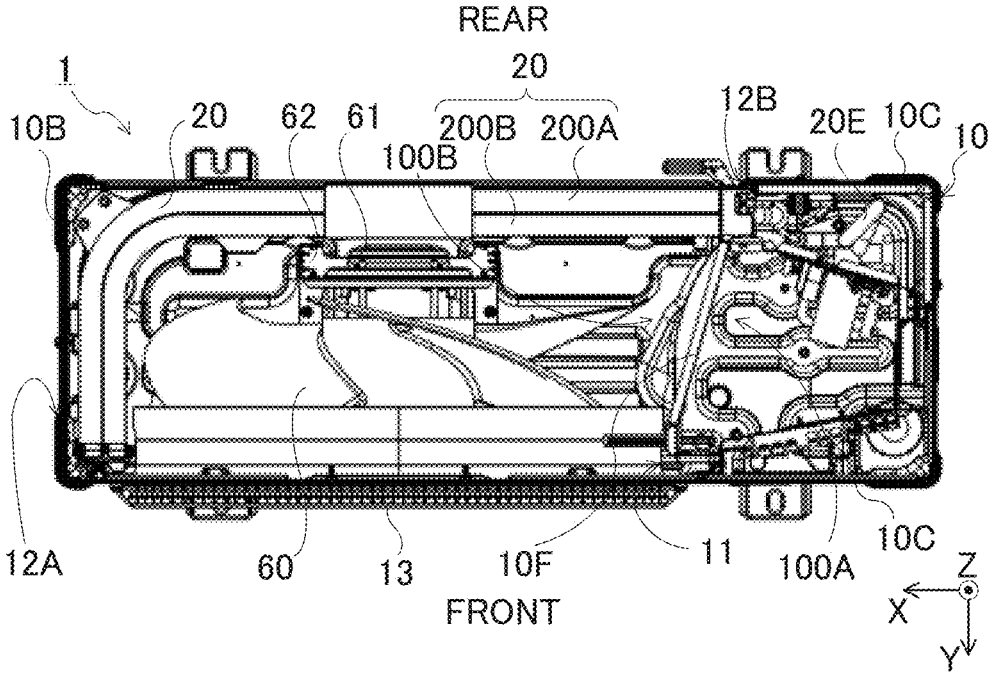
FIG. 3 is a top view of the outdoor unit with a top panel removed.
Figure 4:
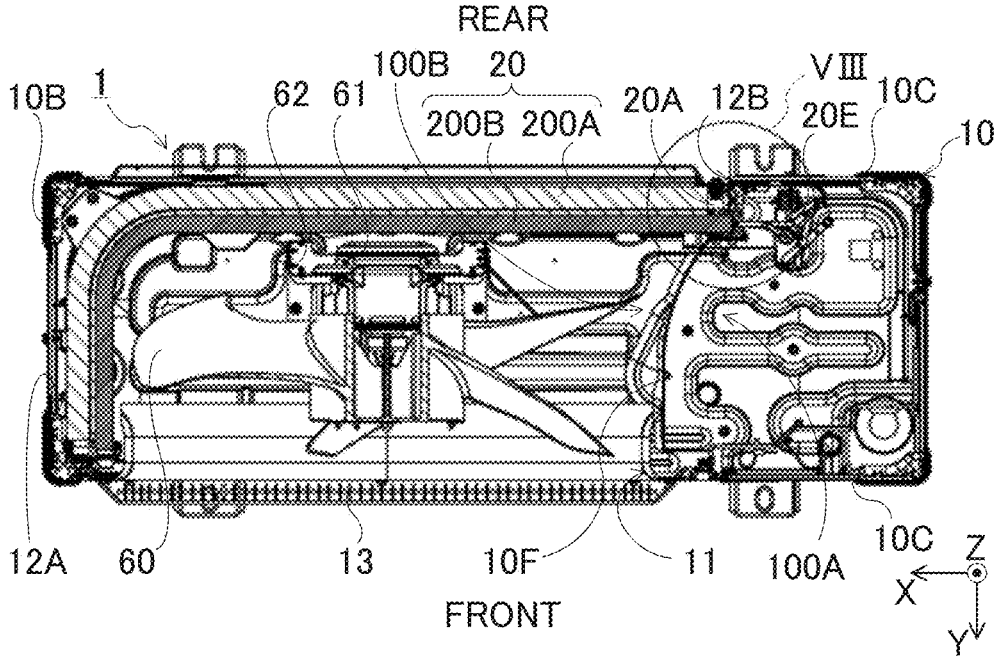
FIG. 4 is a cross-sectional view taken along the line IV-IV of FIG. 1.

FIG. 3 is a top view of the outdoor unit with the top panel 10D removed. FIG. 4 is a cross-sectional view taken along the line IV-IV of FIG. 1. The lower sides of FIGS. 3 and 4 indicate the front side of the outdoor unit 1.

As illustrated in FIGS. 3 and 4, the separator plate 10F extends in the housing 10 from a −X-side inner wall of the air discharge vent 11 to a vicinity of the −X end portion of a heat exchanger 20 in the vicinity of the air inlet 12B. The housing 10 is thereby partitioned into a machine chamber 100A and a fan chamber 100B.

The machine chamber 100A is a space more shielded from the outside air than the fan chamber 100B. The machine chamber 100A contains a compressor, a receiver, a valve, refrigerant tubes 20E that connect the compressor, the receiver, the valve, and a heat exchanger 20 described later to one another, and an electric circuit that controls the compressor, the valve, and other components. To facilitate understanding, the electrical components, such as the compressor and the valve, and the electric circuit are not illustrated in FIGS. 3 and 4.

In contrast to the machine chamber 100A, the fan chamber 100B is a space that communicates with the air inlets 12A and 12B and the air discharge vent 11 and is thus exposed to the outside air. The fan chamber 100B contains a fan 60 that blows the outside air from the air inlets 12A and 12B toward the air discharge vent 11, a motor 61 that rotates the fan 60, and a fan frame 62 that supports the motor 61 and is fastened to the bottom panel 10E and the front panel 10A.

The fan chamber 100B further contains the heat exchanger 20 that causes exchange of heat with the outside air blown by the fan 60. Specifically, most of the heat exchanger 20 that is located on the +X side thereof is contained in the fan chamber 100B. The −Y end of the separator plate 10F is connected to a +Y-side surface that is located on the −X side of the heat exchanger 20, specifically, a cover member 22B described later located on the +Y side. The −X end of the heat exchanger 20 is located in the machine chamber 100A that is located on the −X side of the separator plate 10F. The −X end of the heat exchanger 20 is connected to the refrigerant tube 20E in the machine chamber 100A. The heat exchanger 20 is provided with the protective members 21A and 21B and cover members 22A and 22B, not illustrated in FIGS. 3 and 4, to prevent entry of the outside air from the fan chamber 100B via the heat exchanger 20 to the machine chamber 100A.

Next, the configuration of the heat exchanger 20, the protective members 21A and 21B, and the cover members 22A and 22B is described. The configuration of the heat exchanger 20 with reference to FIGS. 5 to 9 is firstly described, followed by the description of the configuration of the protective members 21A and 21B and the cover members 22A and 22B with reference to FIGS. 10 to 30.

Figure 5:
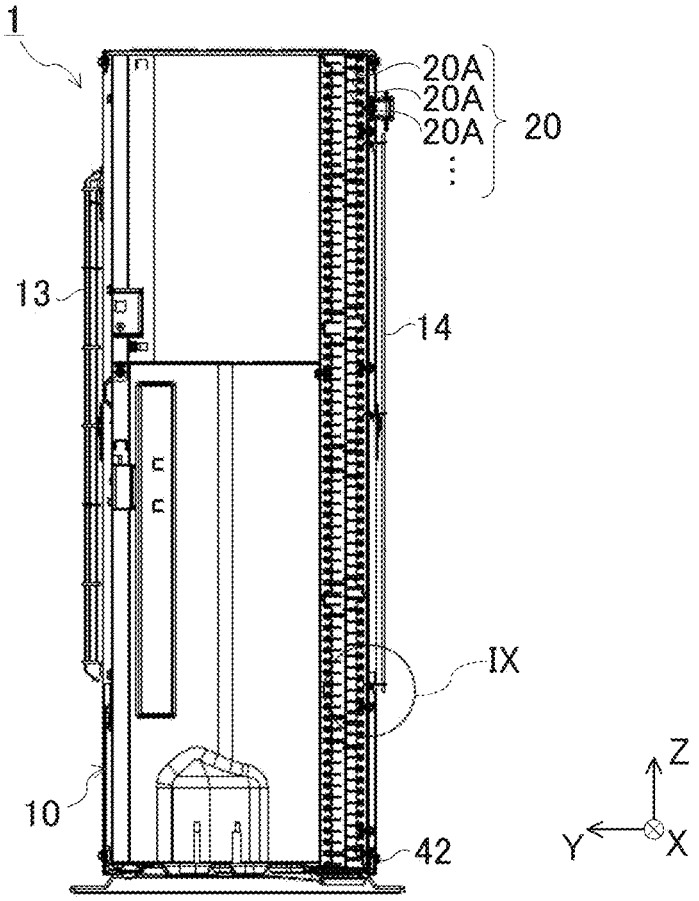
FIG. 5 is a cross-sectional view taken along the line V-V of FIG. 2.
Figure 6:
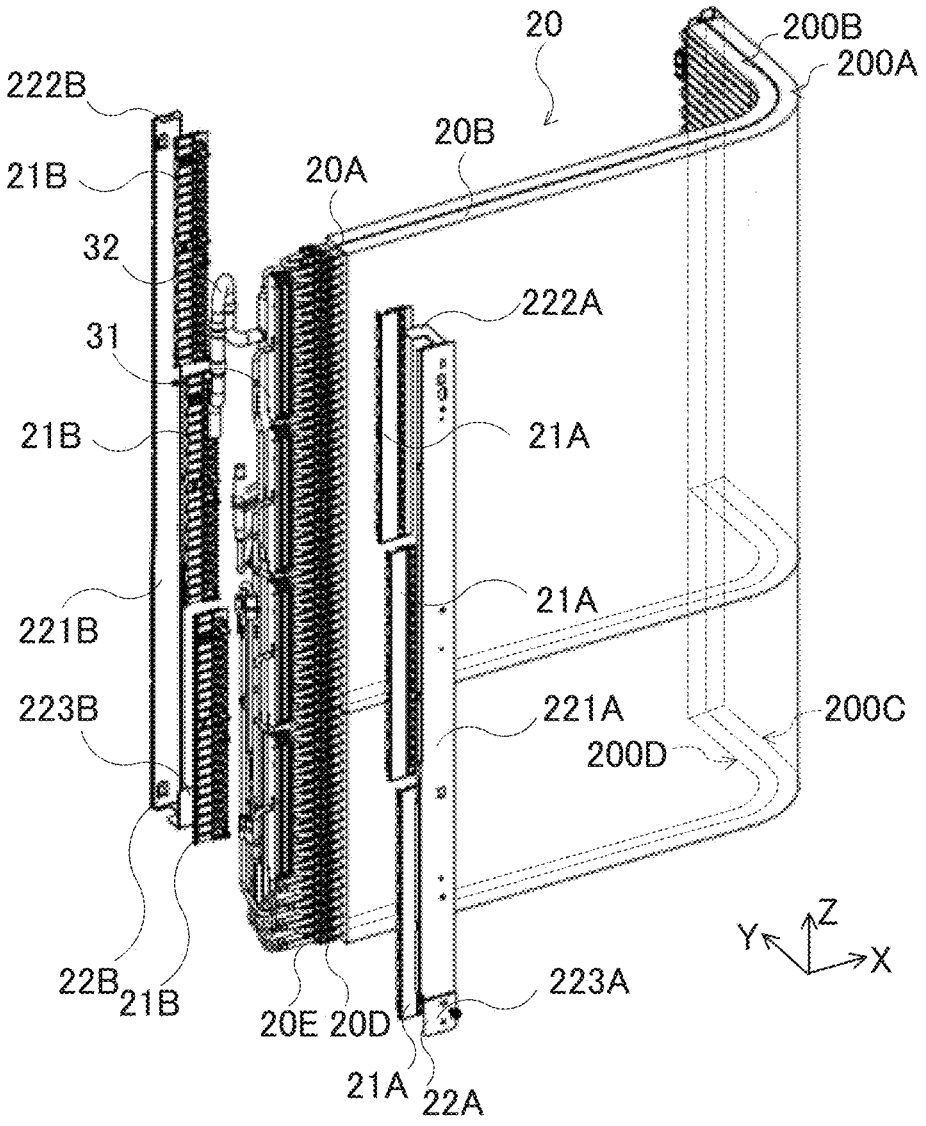
FIG. 6 is a drawing illustrating a component configuration of a heat exchanger, protective members, and cover members.
Figure 7:
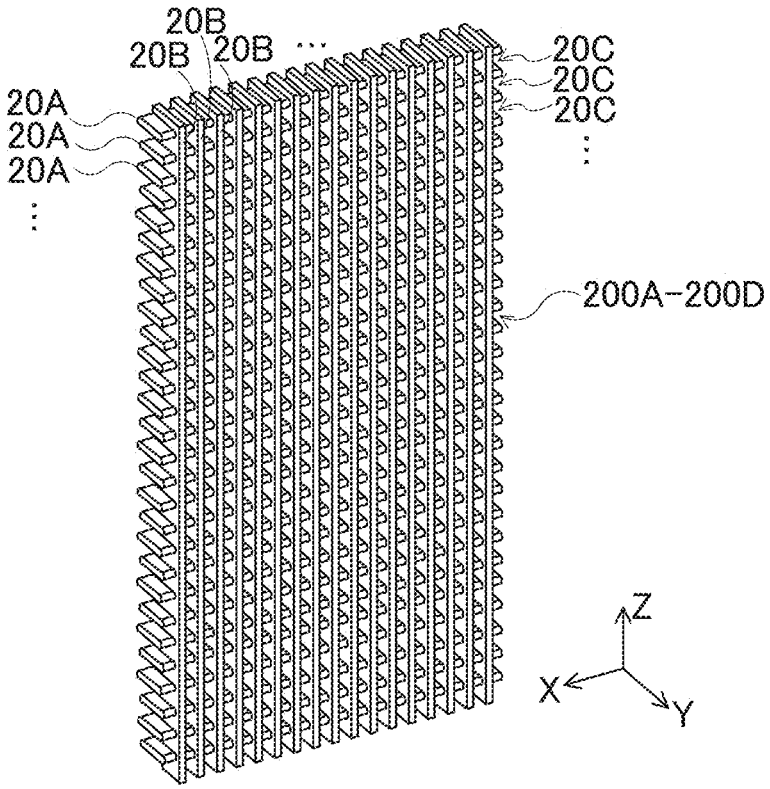
FIG. 7 is a conceptual diagram illustrating a heat exchange unit included in the heat exchanger.
Figure 8:
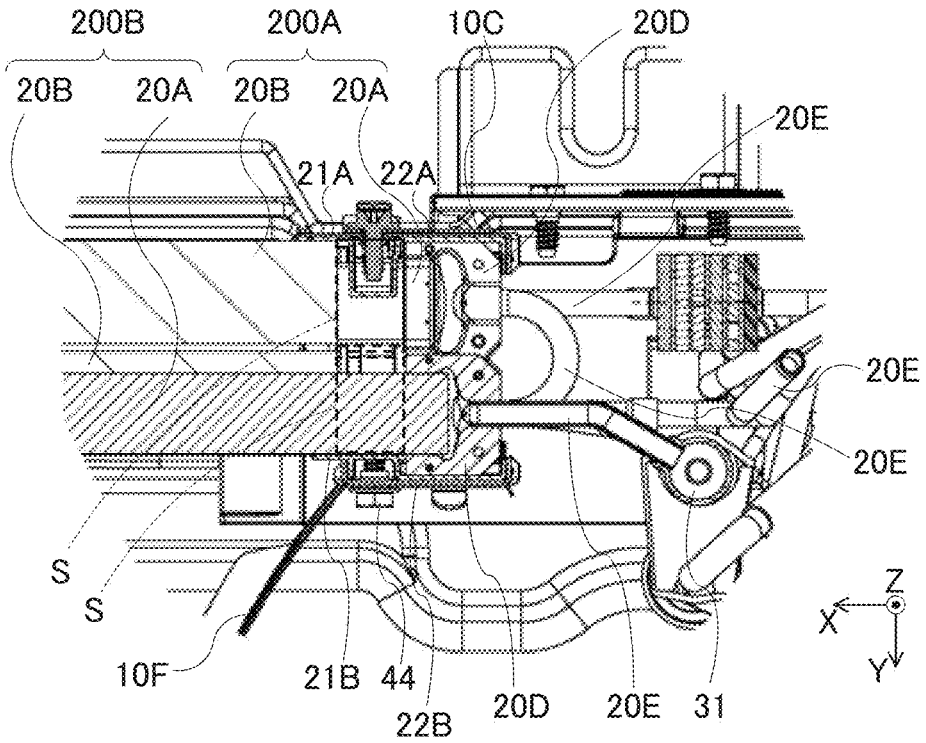
FIG. 8 is an enlarged view of a portion VIII of FIG. 4.
Figure 9:
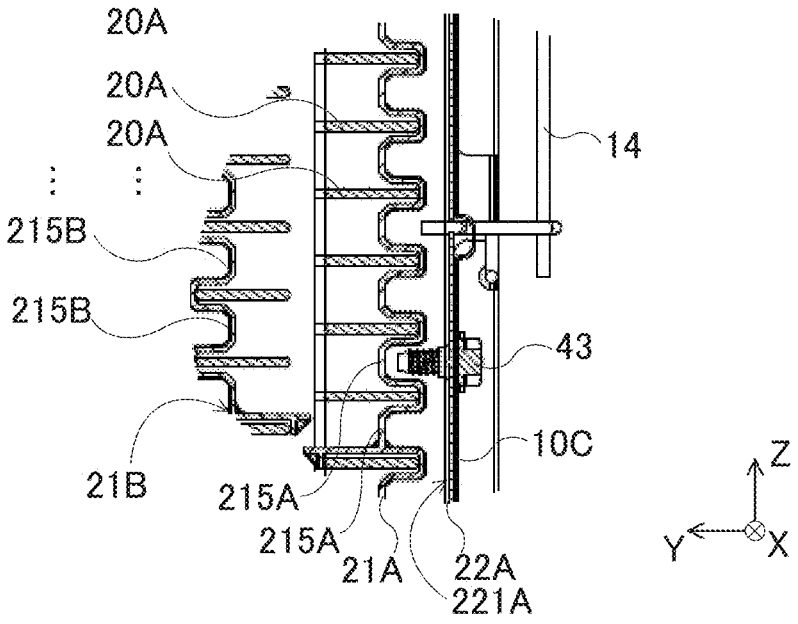
FIG. 9 is an enlarged view of a portion IX of FIG. 5.

FIG. 5 is a cross-sectional view taken along the line V-V of FIG. 2. FIG. 6 is a drawing illustrating a component configuration of the heat exchanger, the protective members, and the cover members. FIG. 7 is a conceptual diagram illustrating a heat exchange unit included in the heat exchanger. FIG. 8 is an enlarged view of a portion VIII of FIG. 4, and FIG. 9 is an enlarged view of a portion IX of FIG. 5.

In FIGS. 6 and 8, multiple fins are simply illustrated as a plate-like structure to facilitate understanding of the configuration of the components. Similarly, the illustration of the multiple fins is also simplified in FIGS. 3, 4, 21 to 24, 27, 32, 33, and 35-37. FIGS. 6 and 7 illustrate the heat exchanger, the protective members, the cover members, and the heat exchange units that are oriented as positioned when installed in the outdoor unit 1.

As illustrated in FIG. 6, the heat exchanger 20 includes four units consisting of heat exchange units 200A to 200D. To increase a heat exchange area of the housing 10 having a rectangular parallelepiped shape, the heat exchange units 200A to 200D are shaped like a plate bent 90° and are shaped to face the air inlets 12A and 12B in the installed state in the outdoor unit 1. The heat exchanger 20 includes an upper part and a lower part that is adjacent to the underside of the upper part. The upper part includes the heat exchange unit 200A and the heat exchange unit 200B that is adjacent to the +Y side of the heat exchange unit 200A. The lower part includes the heat exchange unit 200C and the heat exchange unit 200D that is adjacent to the +Y side of the heat exchange unit 200C.

As illustrated in FIG. 7, the heat exchange units 200A to 200D include multiple heat transfer tubes 20A for a flow of refrigerant, and multiple fins 20B for exchange of heat with the outside air by transmission from the refrigerant and through the heat transfer tubes 20A.

The heat transfer tubes 20A take the form of flat tubes to improve heat-exchange efficiency, as illustrated in FIGS. 5, 7, and 9. The heat transfer tubes 20A extend linearly in the X direction as illustrated in FIG. 7. The heat transfer tubes 20A are arranged in parallel to one another in the Z direction to define spaces 20C between the heat transfer tubes 20A to allow the outside air to pass through the spaces 20C. The heat transfer tubes 20A are made of an aluminum alloy with high heat-exchange efficiency. The fins 20B extend from the heat transfer tubes 20A.

The fins 20B have a rectangular and plate-like shape. Plate surfaces of the fins 20B are arranged in parallel to the YZ plane, and the longitudinal direction of the fins 20B is oriented in the Z direction. The fins 20B are spaced apart from one another in the X direction to allow through flow of the outside air between the fins 20B. The fins 20B are each perpendicular to the heat transfer tubes 20A. The overall structure of the fins 20B and the heat transfer tubes 20A is thus grid-like. The fins 20B are made of an aluminum alloy to improve the heat-exchange efficiency.

As illustrated in FIG. 8, each of the heat exchange units 200A and 200B includes couplings 20D and the refrigerant tubes 20E to allow inflow of refrigerant to the heat transfer tubes 20A or outflow of the refrigerant from the heat transfer tubes 20A. The couplings 20D are provided on the −X ends of the heat transfer tubes 20A and the refrigerant tubes 20E are connected to the −X ends of the heat transfer tubes 20A via the couplings 20D. Here, multiple couplings 20D and multiple refrigerant tubes 20E, although not illustrated in FIG. 8, are provided to correspond to the multiple heat transfer tubes 20A in each of the heat exchange units 200A and 200B. Although not illustrated in FIG. 8, the heat exchange units 200C and 200D basically have the same structure as the heat exchange units 200A and 200B. The structure common to the heat exchange units is described below using the heat exchange units 200A and 200B as an example, and the description for the heat exchange units 200C and 200D is omitted.

The refrigerant tube 20E, as illustrated in FIG. 8, connects the −X end of the heat transfer tube 20A of the heat exchange unit 200A to the −X end of the heat transfer tube 20A of the heat exchange unit 200B that is adjacent to that heat transfer tube 20A of the heat exchange unit 200A. Connection of the heat transfer tubes 20A using the refrigerant tubes 20E forms one or more flow paths of refrigerant. Another refrigerant tube 20E connects the −X end of the heat transfer tube 20A to a collector tube 31.

Each coupling 20D is connected to the end portion of the corresponding heat transfer tube 20A, and a space S lies between each coupling 20D and the most-negative-X-side fin 20B of the fins 20B.

As described above, most of the heat exchanger 20 that is located on the +X side is disposed in the fan chamber 100B, whereas the −X end of the heat exchanger 20 is disposed in the machine chamber 100A. The above-described coupling 20D is located across a portion between the fan chamber 100B and the machine chamber 100A. Thus the outside air may flow into the machine chamber 100A through the spaces S. Specifically, as illustrated in FIG. 8, the spaces S are located between the −Y end of the separator plate 10F and the air inlet 12B, which may cause inflow of the outside air through the spaces 20C between the multiple heat transfer tubes 20A illustrated in FIG. 7. A set of the protective member 21A and the cover member 22A and a set of the protective member 21B and the cover member 22B are disposed against openings of the space S to enclose the spaces 20C from both sides of the heat exchanger 20 in the Y direction, thereby preventing entry of the outside air and rainwater.

Specifically, the protective member 21A and the cover member 22A are disposed against the −X-side opening of the space S. The protective member 21A covers the most-negative-X-side fin 20B, the heat transfer tubes 20A, and the couplings 20D from the −Y side of the heat exchange unit 200A. The cover member 22A covers the protective member 21A from the −Y side of the heat exchange unit 200A and abuts the inner wall of the rear panel 10C. Similarly, the protective member 21B and the cover member 22B are disposed against the +X-side opening of the space S. The protective member 21B covers the most-negative-X-side fin 20B, the heat transfer tubes 20A, and the couplings 20D from the +Y-side of the heat exchange unit 200B. The cover member 22B covers the protective member 21B from the +Y side of the heat exchange unit 200B, and the −Y end of the separator plate 10F abuts the cover member 22B. The configuration of the protective members 21A and 21B and the cover members 22A and 22B is next described with reference to FIGS. 10 to 30. The protective members 21A and 21B are firstly described, followed by the description of the cover members 22A and 22B.

Figure 10:
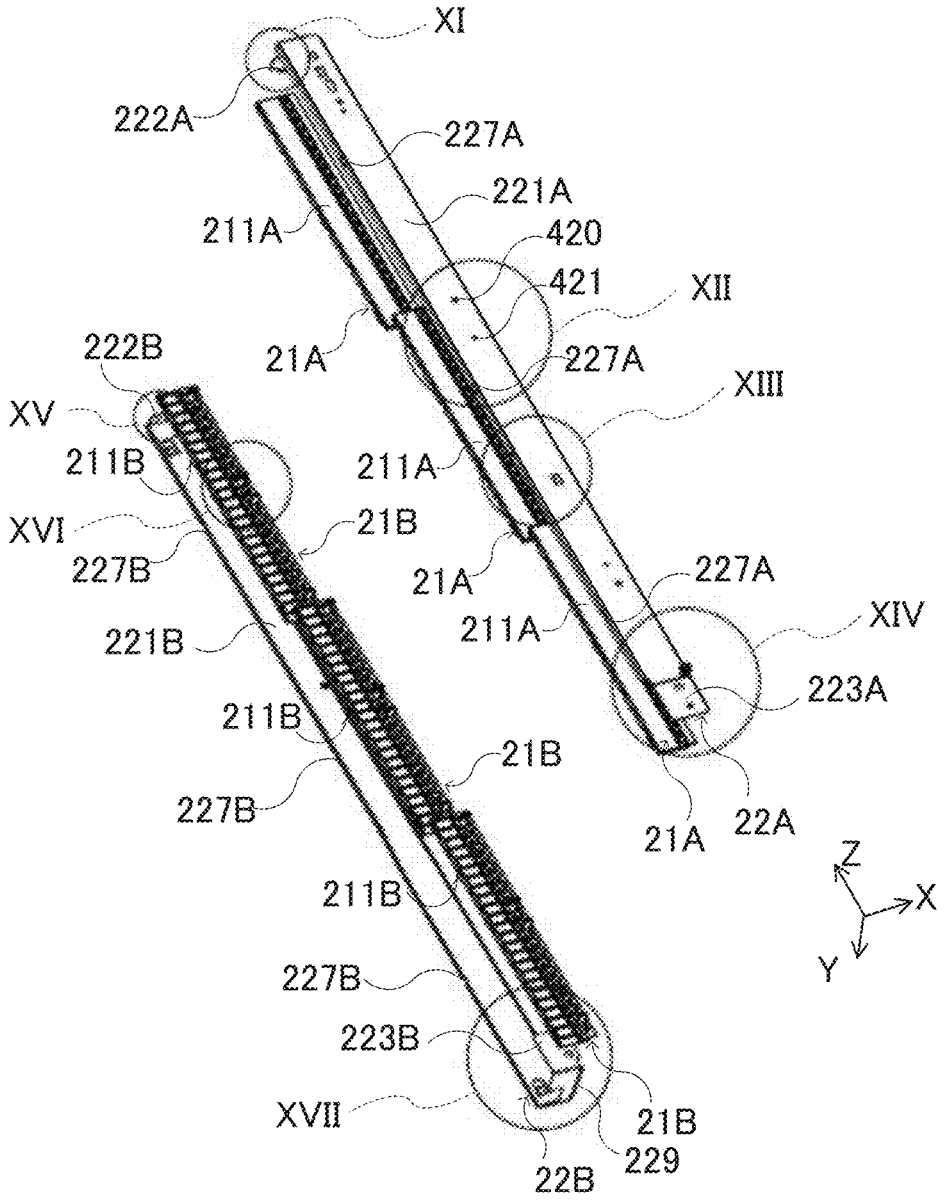
FIG. 10 is a perspective view illustrating the protective members and the cover members.
Figure 11:
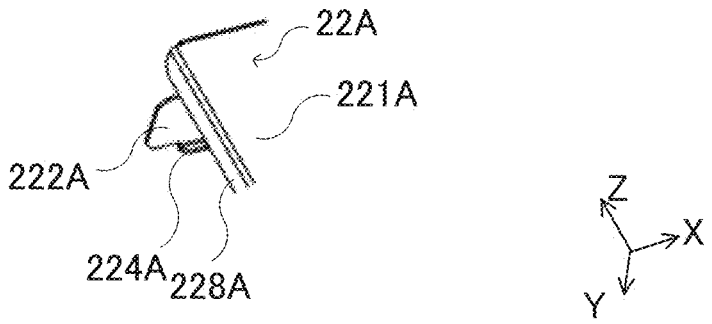
FIG. 11 is an enlarged view of a portion XI of FIG. 10.
Figure 12:
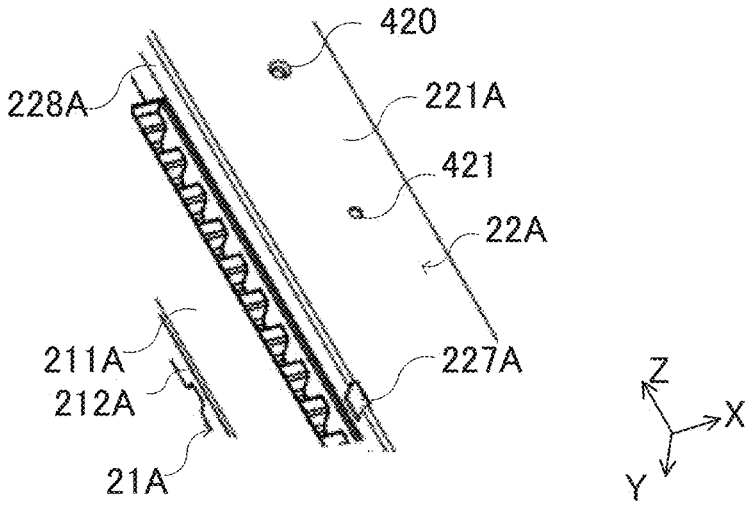
FIG. 12 is an enlarged view of a portion XII of FIG. 10.
Figure 13:
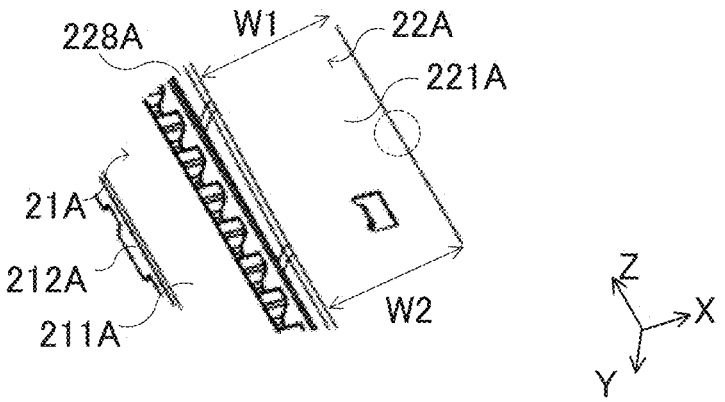
FIG. 13 is an enlarged view of a portion XIII of FIG. 10.
Figure 14:
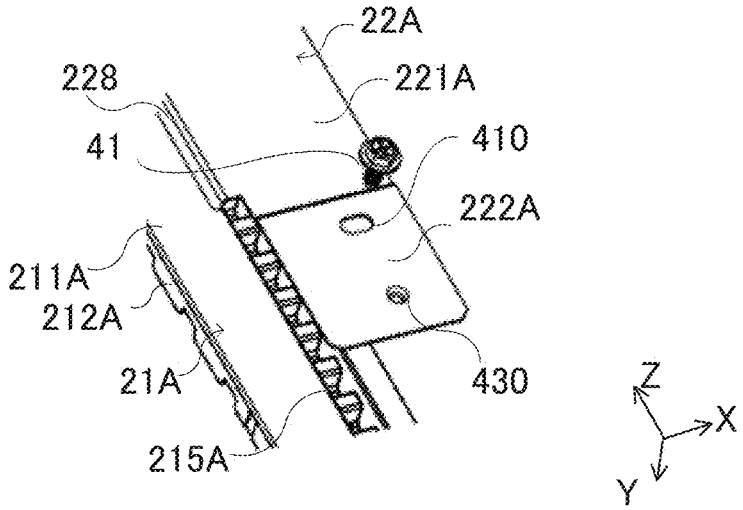
FIG. 14 is an enlarged view of a portion XIV of FIG. 10.
Figure 15:
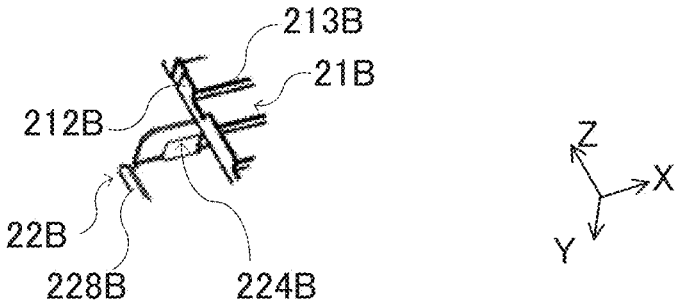
FIG. 15 is an enlarged view of a portion XV of FIG. 10.
Figure 16:
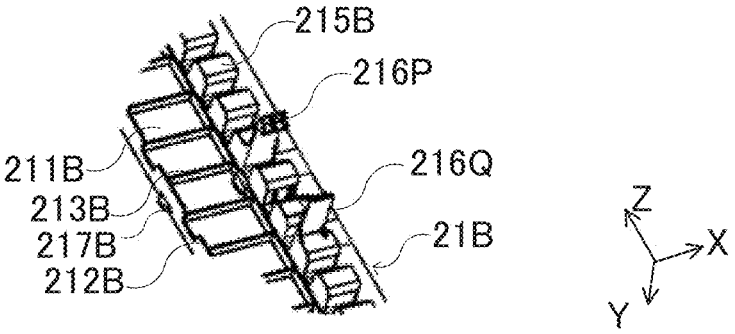
FIG. 16 is an enlarged view of a portion XVI of FIG. 10.
Figure 17:
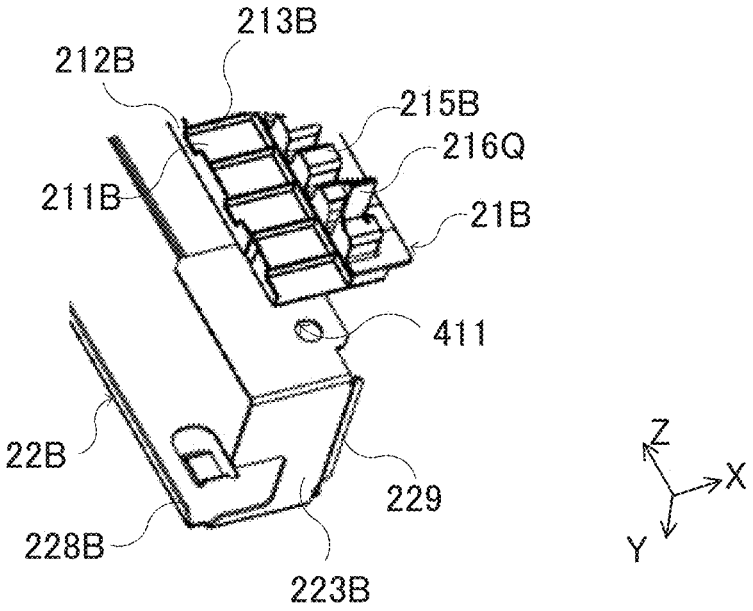
FIG. 17 is an enlarged view of a portion XVII of FIG. 10.
Figure 18:
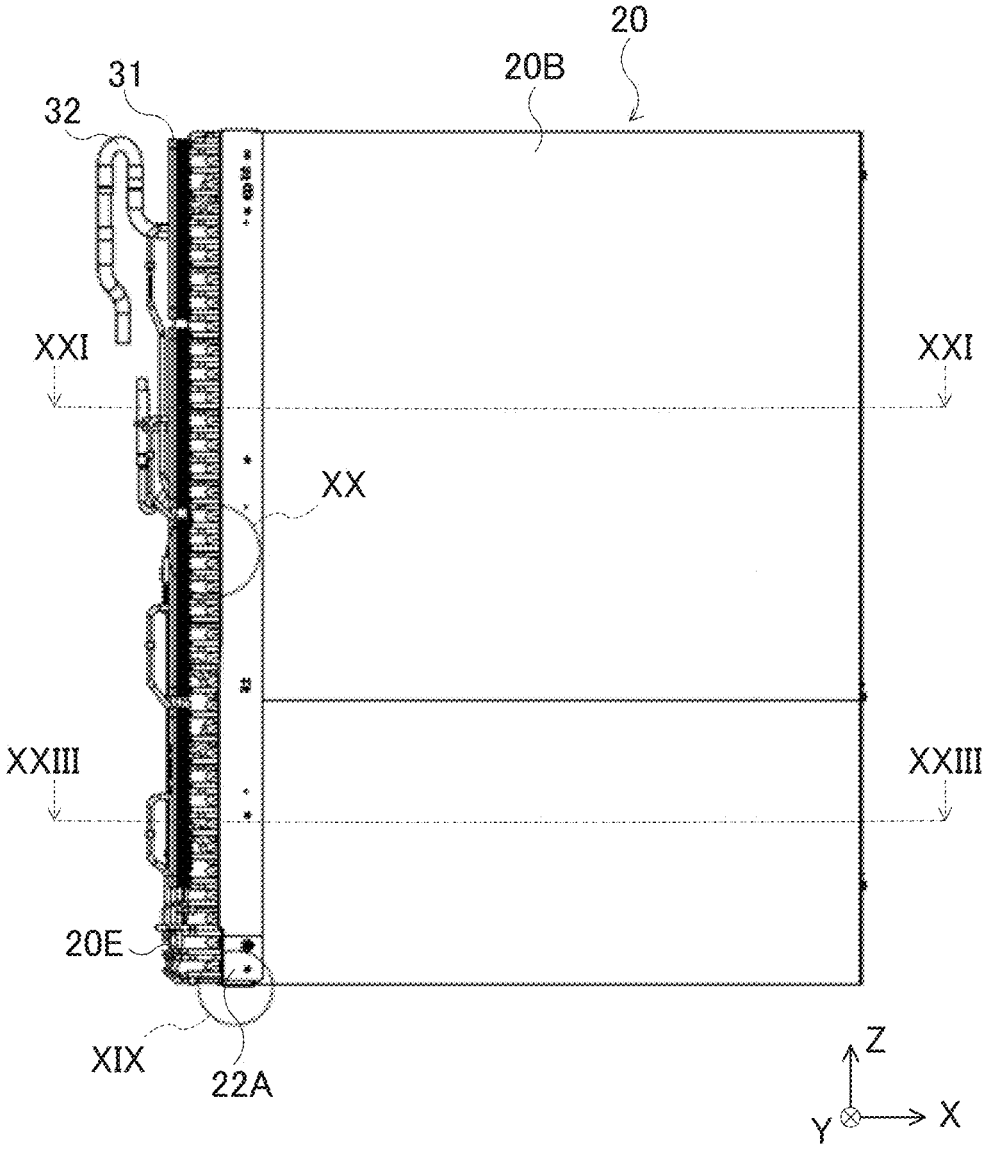
FIG. 18 is a rear view illustrating the heat exchanger with the protective members and the cover members attached.
Figure 19:
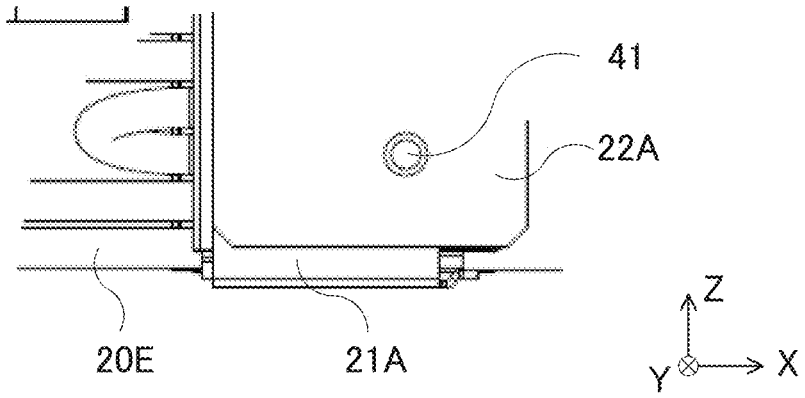
FIG. 19 is an enlarged view of a portion XIX of FIG. 18.
Figure 20:
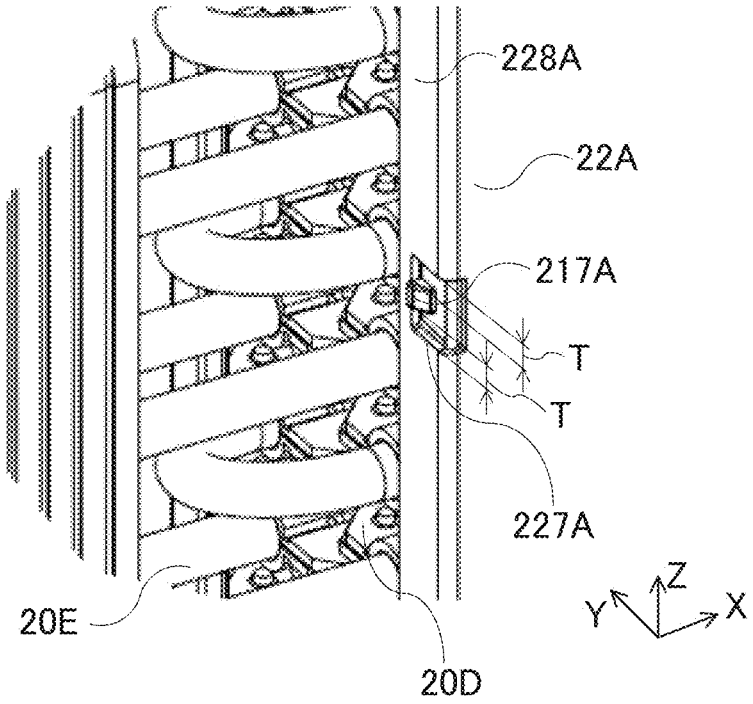
FIG. 20 is a perspective view of a portion XX of FIG. 18.
Figure 21:
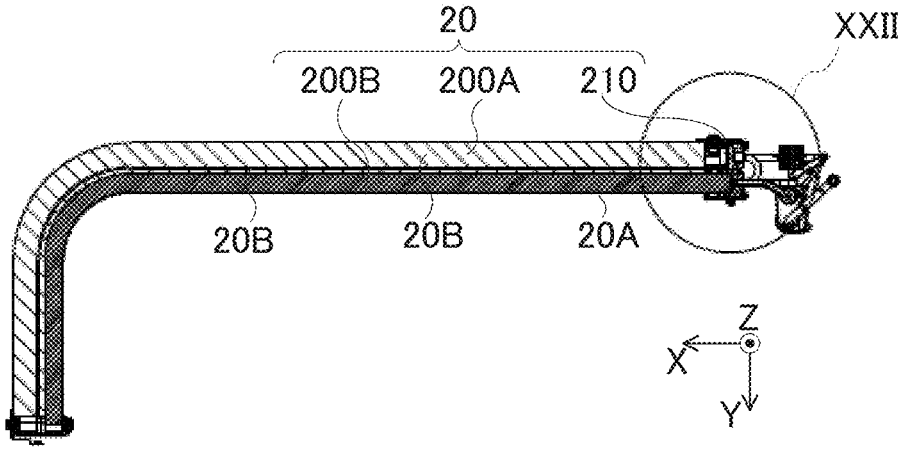
FIG. 21 is a cross-sectional view taken along the line XXI-XXI of FIG. 18.
Figure 22:
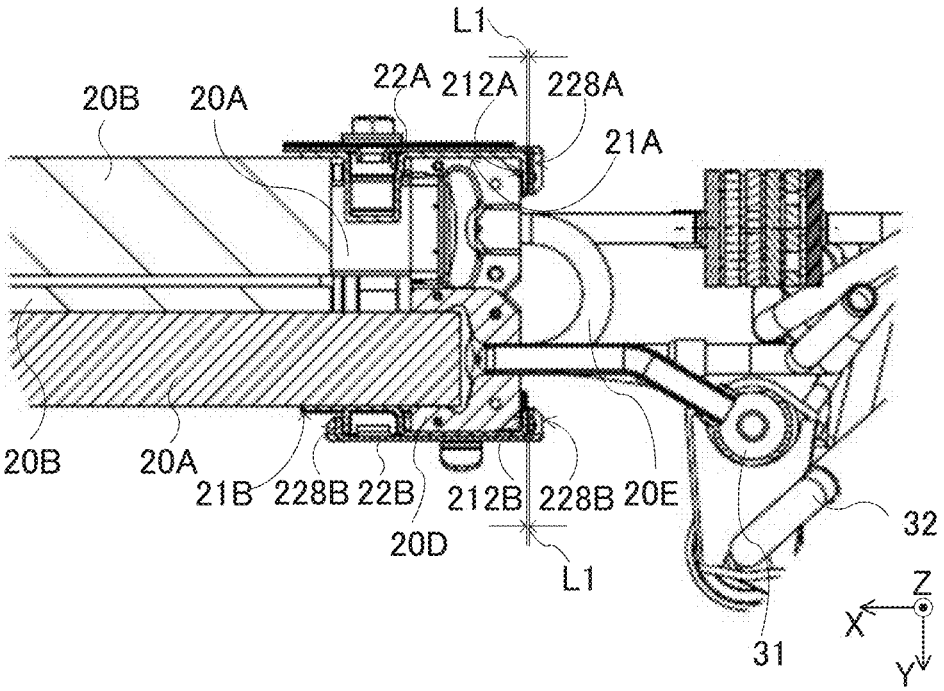
FIG. 22 is an enlarged view of a portion XXII of FIG. 21.
Figure 23:
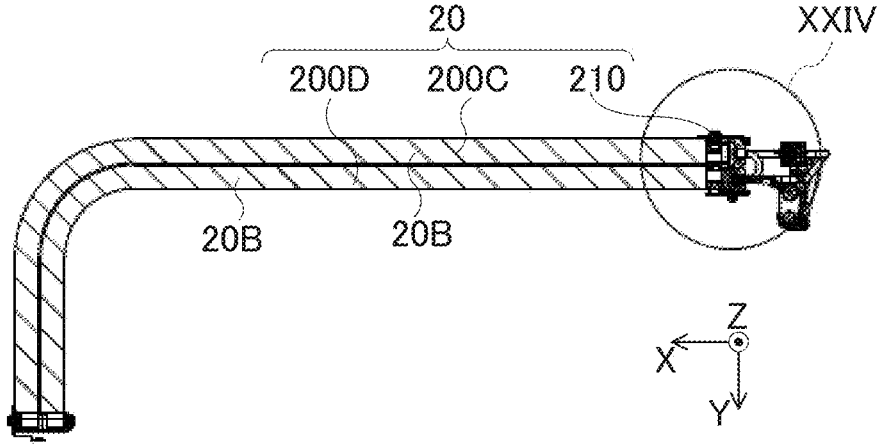
FIG. 23 is a cross-sectional view taken along the line XXIII-XXIII of FIG. 18.
Figure 24:
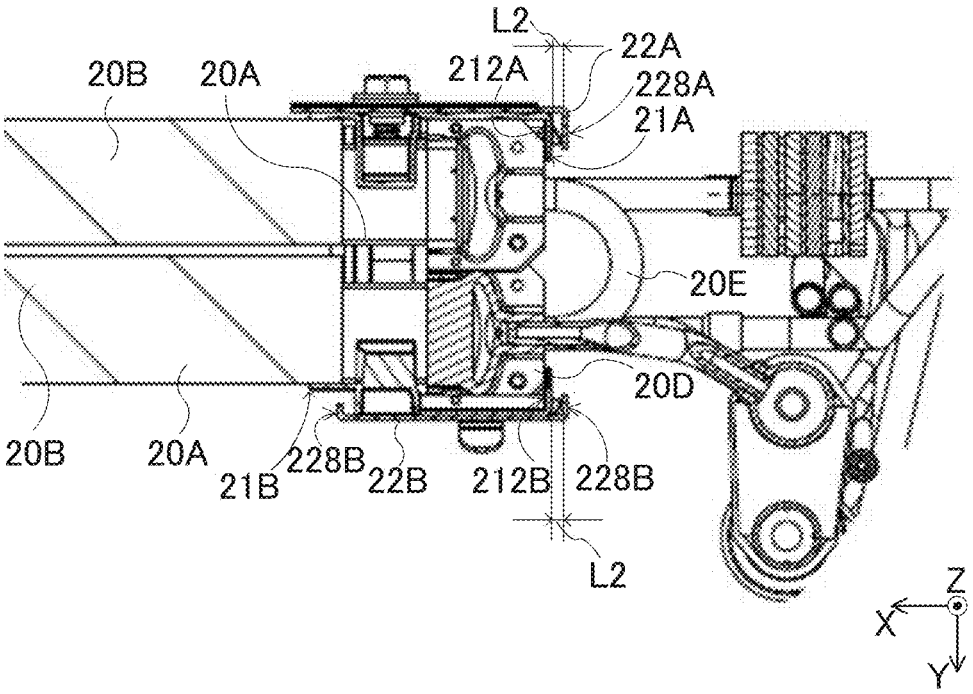
FIG. 24 is an enlarged view of a portion XXIV of FIG. 23.
Figure 25:
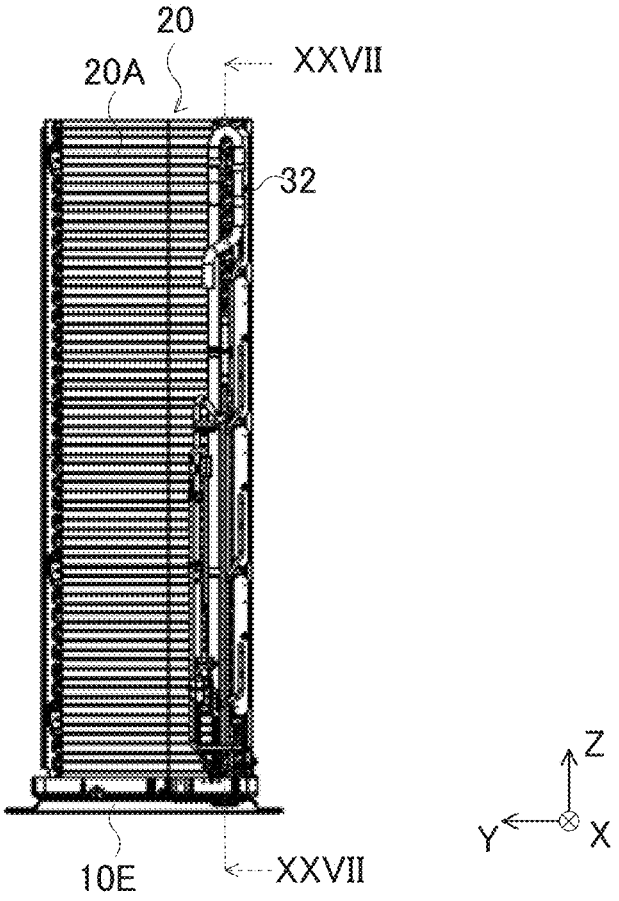
FIG. 25 is a side view illustrating the heat exchanger fastened to a bottom casing, with the protective members and the cover members attached to the heat exchanger.
Figure 26:
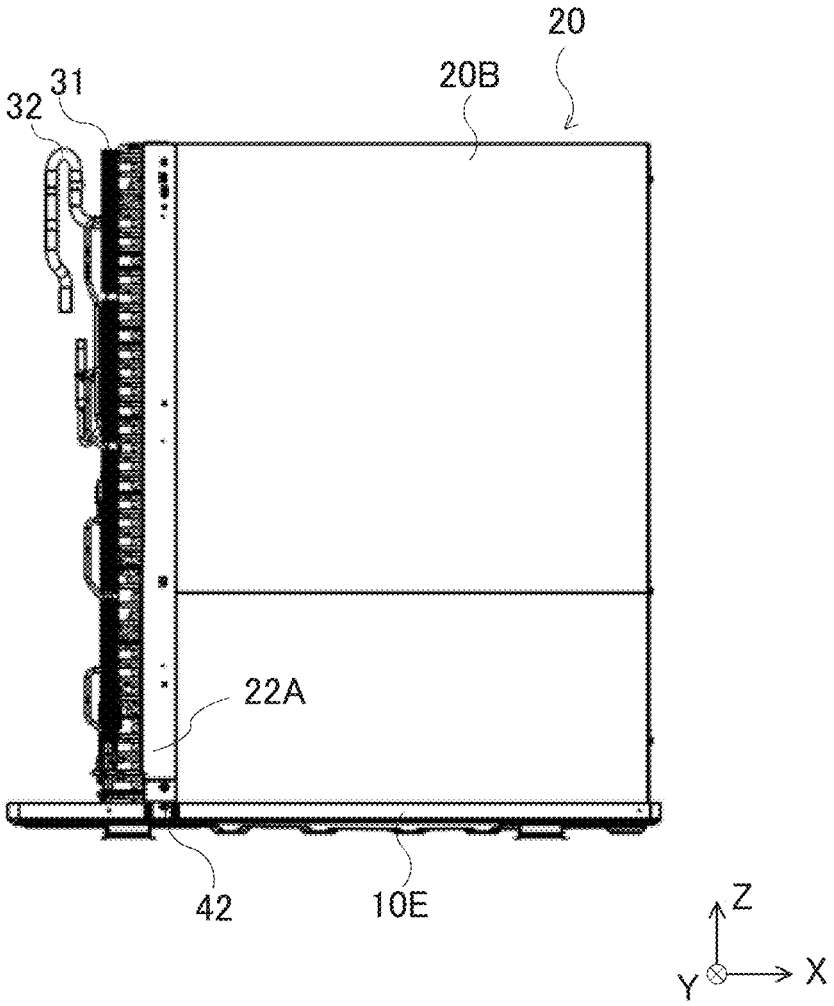
FIG. 26 is a front view illustrating the heat exchanger fastened to the bottom casing, with the protective members and the cover members attached to the heat exchanger.
Figure 27:
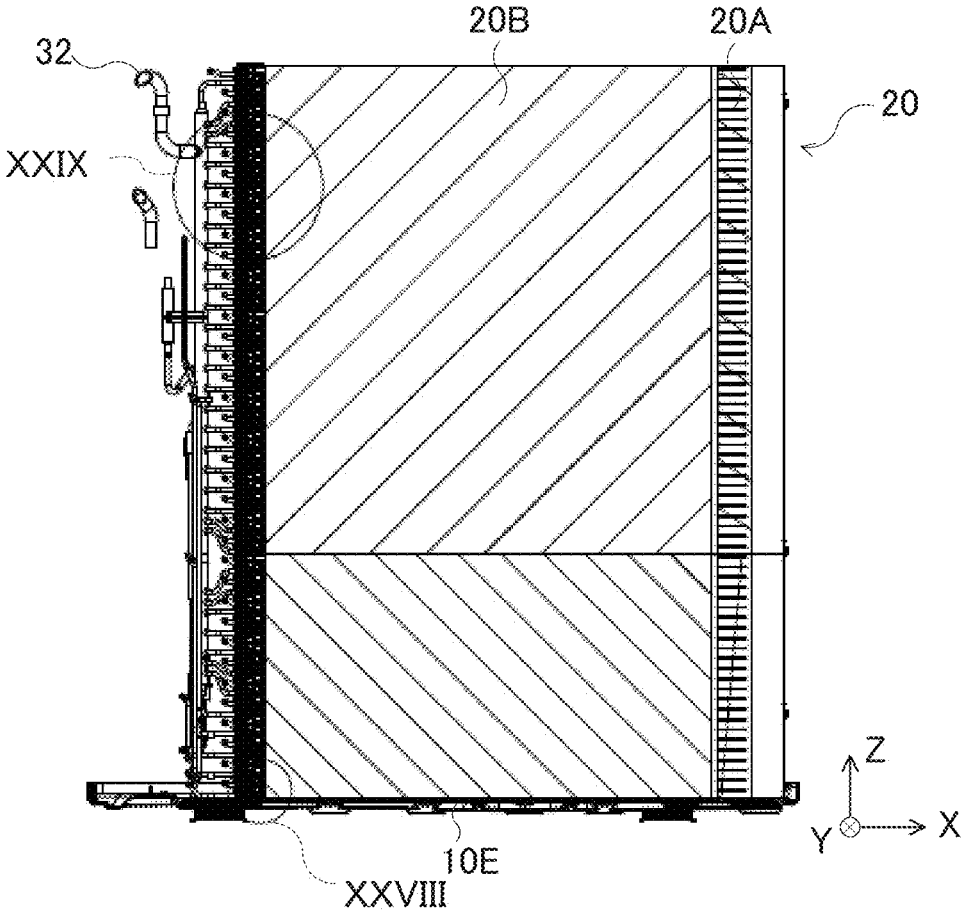
FIG. 27 is a cross-sectional view taken along the line XXVII-XXVII of FIG. 25.
Figure 28:
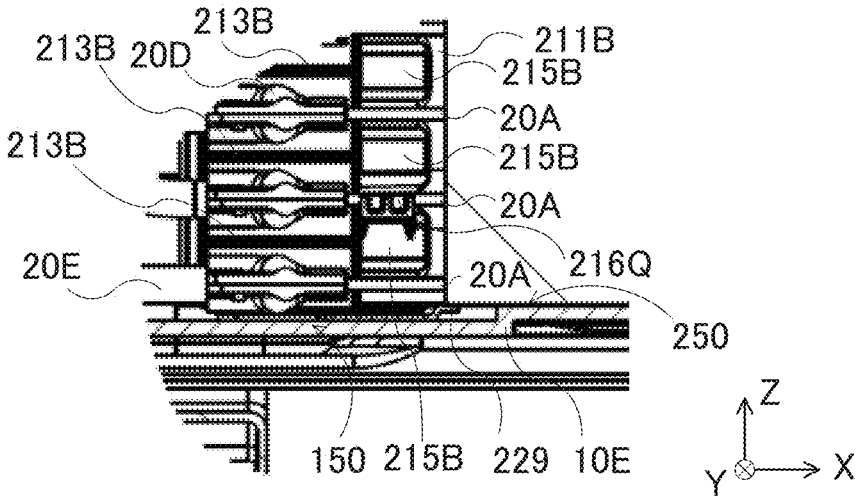
FIG. 28 is an enlarged view of a portion XXVIII of FIG. 27.
Figure 29:
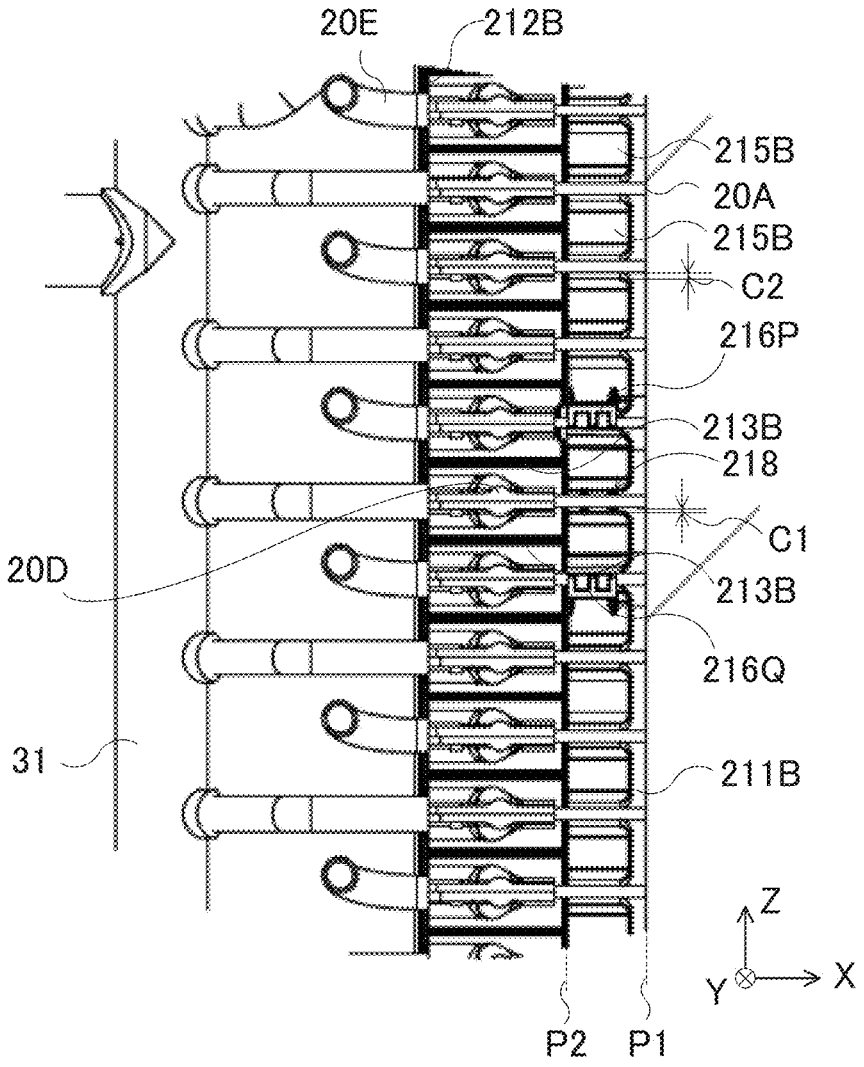
FIG. 29 is an enlarged view of a portion XXIX of FIG. 27.
Figure 30:
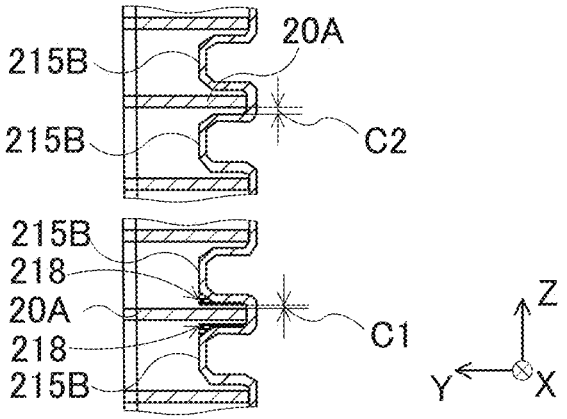
FIG. 30 is a cross-sectional view illustrating a state of a clearance between the heat transfer tube and a protrusion of the protective member of the heat exchanger.

FIG. 10 is a perspective view illustrating the protective members and the cover members. FIG. 11 is an enlarged view of a portion XI of FIG. 10. FIG. 12 is an enlarged view of a portion XII of FIG. 10. FIG. 13 is an enlarged view of a portion XIII of FIG. 10. FIG. 14 is an enlarged view of a portion XIV of FIG. 10. FIG. 15 is an enlarged view of a portion XV of FIG. 10. FIG. 16 is an enlarged view of a portion XVI of FIG. 10. FIG. 17 is an enlarged view of a portion XVII of FIG. 10. FIG. 18 is a rear view illustrating the heat exchanger 20 with the protective members 21A and 21B and the cover members 22A and 22B attached. FIG. 19 is an enlarged view of a portion XIX of FIG. 18. FIG. 20 is a perspective view of a portion XX of FIG. 18. FIG. 21 is a cross-sectional view taken along the line XXI-XXI of FIG. 18. FIG. 22 is an enlarged view of a portion XXII of FIG. 21. FIG. 23 is a cross-sectional view taken along the line XXIII-XXIII of FIG. 18. FIG. 24 is an enlarged view of a portion XXIV of FIG. 23. FIG. 25 is a side view illustrating the heat exchanger fixed to a bottom casing, with the protective members and the cover members attached to the heat exchanger. FIG. 26 is a front view illustrating the heat exchanger fixed to the bottom casing, with the protective members and the cover members attached to the heat exchanger. FIG. 27 is a cross-sectional view taken along the line XXVII-XXVII of FIG. 25. FIG. 28 is an enlarged view of a portion XXVIII of FIG. 27. FIG. 29 is an enlarged view of a portion XXIX of FIG. 27. FIG. 30 is a cross-sectional view illustrating a state of a clearance between the heat transfer tube and a protrusion of the protective member of the heat exchanger.

The protective member 21A has substantially the same configuration as the protective members 21B, and the cover member 22A has substantially the same configuration as the cover member 22B. In the following description, the same reference signs are used to refer to the same or like configurations, and the configurations are identified by suffixes A and B added to the end of the reference signs.

As illustrated in FIG. 10, three protective members 21A and three protective members 21B are used for each Y-direction side of the heat exchanger 20 in order to keep the heat transfer tubes 20A covered even when the heat transfer tubes 20A deform by expansion or contraction of refrigerant or heating or cooling of the heat transfer tubes 20A. The three protective members 21A and the three protective members 21B are arranged in the Z direction and separately attached to the heat exchanger 20.

The protective members 21A and 21B are made of a material deformable to accommodate the shape of the heat exchanger 20 even when the heat exchanger 20 becomes warped. That is, the protective members 21A and 21B are made of a more flexible material than the material of the heat transfer tubes 20A. Specifically, the protective members 21A and 21B are made of a polypropylene resin.

As illustrated in FIG. 10, the protective members 21A and 21B have rectangular flat plates 211A and 211B (hidden in the back), respectively. Here, FIG. 10 and FIGS. 15 to 17 are perspective views illustrating the protective members 21A and 21B and the cover members 22A and 22B when viewed from the front. Thus, in FIG. 10 and FIGS. 15 to 17, only plate surfaces of the flat plates 211A that are located on the front side of the protective members 21A appear in the drawings, and the rear-side structure of the plate surfaces 211A is hidden in the back of the plate surfaces of the flat plates 211A. In contrast, the front-side structure of the flat plates 211B of the protective members 21B appears in FIG. 10 and FIGS. 15 to 17. The protective members 21A and 21B have substantially the same structure. Here, the Y-direction shapes of the protective members 21A and 21B are not completely but generally symmetrical relative to each other because the heat transfer tubes 20A are eccentrically disposed relative to the fins 20B. Thus, the meaning of the phrase "substantially the same configuration" includes being generally symmetrical relative to each other. In the following description, when the description using the front-side structure of the protective member 21B as an example is provided, the description of the rear-side structure of the protective member 21A is omitted. Similarly, the description that is made as an example for the front-side structure of the protective member 21A is used for the description of the rear-side structure of the protective member 21B; that is, the description of the rear-side structure of the protective member 21B is omitted. The same applies to the description based on FIG. 20.

As illustrated in FIGS. 15 to 17, the protective member 21B includes the flat plate 211B described above, a side wall 212B, multiple ribs 213B, a protruding claw 217B, protrusions 215B, and a pair of locking claws 216P and 216Q. The side wall 212B is formed on the −Y-side plate surface of the flat plate 211B and extends along the −X end plane of the flat plate 211B in the Z direction. The ribs 213B extend from the side wall 212B in the +X direction. The protruding claw 217B is provided on the +Y end of the −X-direction side surface as illustrated in FIG. 16. The protrusions 215B are provided on the +X side of the flat plate 211B, and protrude in the −Y direction. The locking claws 216P and 216Q protrude from between the protrusions 215B in the −Y direction. The protrusions 215B are arranged in the Z direction.

The protective member 21A has a recessed shape that is recessed from the −Y ends of protrusions 215A toward the +Y side, as illustrated in FIG. 9. The recessed shape of the protective member 21A is provided for accommodating the tip portion of a screw 43 to prevent the screw 43 from damaging the heat transfer tubes 20A when the cover member 22A is fastened by screwing. Although not illustrated, the protective member 21B is also recessed from the +Y ends of the protrusions 215B toward the −Y side.

As illustrated in FIGS. 28 and 29, the plate surface of the flat plate 211B is disposed in parallel to the XZ plane in the assembled state in the outdoor unit 1. Further, the plate surface of the flat plate 211B is located on the +Y side relative to: the fin 20B located on the −X-side end portion of the heat exchange unit 200B, the heat transfer tubes 20A, and the couplings 20D. That is, the flat plate 211B covers the end fin 20B of the heat exchange unit 200B, the heat transfer tubes 20A, and the couplings 20D from the +Y side thereof. Similarly, the flat plate 211A covers the end portion of the heat exchange unit 200A from the −Y side thereof.

As illustrated in FIGS. 22, 24, and 29, the wall surface of the side wall 212B abuts the −X end surface of the couplings 20D in the assembled state in the outdoor unit 1. This arrangement of the side wall 212B provides protection for the couplings 20D. The multiple ribs 213B also protect the couplings 20D with each coupling 20D sandwiched between two ribs 213B from the +Z side and −Z side, as illustrated in FIGS. 28 and 29. With similar arrangement, a side wall 212A and ribs 213A also protect the couplings 20D.

With reference again to FIG. 16, the protruding claw 217B is provided to fasten the protective member 21B to the cover member 22B. The protective member 21A is also provided with a protruding claw 217A having the similar structure, as illustrated in FIG. 20. As illustrated in FIG. 20, the protruding claw 217A is shaped to be insertable into a restraint hole 227A of the cover member 22A. The protruding claw 217A is locked in the restraint hole 227A upon insertion into the restraint hole 227A. This locking mechanism fastens the protective member 21A to the cover member 22A. Similarly, the protruding claw 217B of the protective member 21B is inserted into a restraint hole 227B of the cover member 22B.

The protrusions 215B of the protective member 21B, as illustrated in FIGS. 28 and 29, each protrude toward a space between the heat transfer tubes 20A arranged in the Z direction of the heat exchange unit 200B and fill most of the space. The protrusions 215B have a size smaller than the space between the heat transfer tubes 20A to allow attachment of the protective member 21B to the heat exchanger 20 even when the heat transfer tubes 20A is deformed. For each protrusion 215B, a clearance C2 exists between the side surface of each protrusion 215B and the corresponding heat transfer tube 20A in the assembled state in the heat exchanger 20. Among the clearances C2, a clearance C2 located in the middle portion of the protective member 21B in the Z direction is smaller than each of clearances C2 located on both sides of the protective member 21B in the Z direction. Here, the clearance C2 is sized so as to prevent droplets from passing therethrough. Similarly, the protrusions 215A of the protective member 21A each protrude toward a space between the heat transfer tubes 20A, and the clearance C2 also exists.

The locking claws 216P and 216Q engage with the same heat transfer tube 20A and hold the heat transfer tube 20A therebetween. The locking claws 216P and 216Q thereby fasten the protective member 21B to the heat transfer tubes 20A to maintain the state in which the protrusions 215B fill the space. As a result, the protective member 21B protects the heat transfer tubes 20A of the heat exchange unit 200B and blocks a path of entry of the outside air and rainwater. To facilitate attachment of the protective member 21B when the heat transfer tubes 20A deform, the locking claws 216P and 216Q are not provided along the entire flat plates 211B, but rather are provided in just three locations that are the middle portion and both end portions of the flat plate 211B in the longitudinal direction. Specifically, the pair of locking claws 216P and 216Q is provided in the middle portion and another pair of locking claws 216P and 216Q is provided on each of both the end sides in the Z direction. With the similar arrangement, the protective member 21A protects the heat transfer tubes 20A of the heat exchange unit 200A and blocks the path of entry of the outside air and rainwater.

The protrusions 215B between the locking claws 216P and 216Q, as illustrated in FIGS. 29 and 30, have positioning ribs 218 extending in the Z direction. The positioning ribs 218 abut the heat transfer tube 20A. As described below about the assembly method for the outdoor unit 1, the positioning ribs 218 position the protective member 21B relative to the heat transfer tubes 20A when the protective member 21B and the outdoor unit 1 are assembled together. Similarly, the protrusions 215A are also provided with the positioning ribs extending in the Z direction.

Next, the configuration of the cover members 22A and 22B is described.

As illustrated in FIGS. 6 and 10, the cover members 22A and 22B include rectangular flat plates 221A and 221B, a top surface portion 222A and a protrusion 222B, a lower side surface portion 223A and a lower support portion 223B, restraint holes 227A and 227B, and a stop 229. The flat plates 221A and 221B cover the protective members 21A and 21B. The top surface portion 222A and the protrusion 222B are provided on the +Z end of the flat plates 221A and 221B. The lower side surface portion 223A and the lower support portion 223B are provided on the −Z end of the flat plates 221A and 221B. The restraint holes 227A and 227B restrain the protruding claws 217A and 217B of the protective members 21A and 21B. The stop 229 defines the positions of the cover members 22A and 22B in the Z direction relative to the bottom panel 10E of the outdoor unit 1.

The flat plates 221A and 221B have a longitudinal length extending in the Z direction to cover the entire protective members 21A and 21B, and a transverse width that is greater than the X-direction widths of the protective members 21A and 21B. The cover members 22A and 22B are made of an aluminum alloy, and the flat plates 221A and 221B are folded sheet metal of the aluminum alloy.

The cover members 22A and 22B may be made of a material other than the aluminum alloy, and may be made of a material having higher or lower stiffness than the aluminum alloy.

As illustrated in FIG. 11 and FIGS. 15 to 17, the flat plates 221A and 221B are provided with side walls 228A and 228B for covering the X-direction end surfaces of the flat plates 211A and 211B of the protective members 21A and 21B. The flat plate 221A is provided with a single side wall 228A and the flat plate 221B is provided with two side walls 228B although those are not illustrated in FIG. 11 and FIGS. 15 to 17. Here, assuming that the cover members 22A and 22B are assembled in the outdoor unit 1, as illustrated in FIGS. 22 and 24, the flat plate 221A is provided, on the +X-side end surface, with the single side wall 228A extending in the Z direction. In contrast, the flat plate 221B is provided with a total of two side walls 228B extending in the Z direction, each of which side walls 228B is provided on the corresponding one of the +X-side and −X-side end surfaces. Thus the flat plate 221A has an inverted L-shape in the XY cross section, and the flat plate 221B has a U-shape in the XY cross section. The flat plates 221A and 221B having such shapes prevent spreading of rainwater if entry of rainwater occurs. As illustrated in FIGS. 6 and 10, the flat plate 221A and the flat plate 221B, respectively, have on the +Z end side the top surface portion 222A and the protrusion 222B that are for interconnection between the flat plates 221A and 221B.

The top surface portion 222A is a folded portion of the flat plate 221A made folded in the +Y direction. The top surface portion 222A is provided with a locking claw 224A that is a +Y-end portion of the top surface portion 222A folded in the −Z direction and protruding toward the −Z side, as illustrated in FIG. 11.

In contrast, the protrusion 222B protrudes from the flat plate 221B toward the −Y side, as illustrated in FIGS. 6 and 10. As illustrated in FIG. 15, the protrusion 222B has a locking hole 224B in which the locking claw 224A of the cover member 22A can be secured. The locking claw 224A of the top surface portion 222A is locked in the locking hole 224B. This results in connection between the +Z end of the cover member 22A and the +Z end of the cover member 22B.

With reference again to FIGS. 6 and 10, the flat plate 221A and the flat plate 221B, respectively, have on the −Z end side the lower side surface portion 223A and the lower support portion 223B that are for interconnection between the flat plates 221A and 221B.

The lower side surface portion 223A is located on a plane stepped relative to the flat plate 221A in the −Y direction The lower side surface portion 223A has an insertion hole 410 for insertion of a screw 41 for fastening the later-described lower support portion 223B of the cover member 22B, as illustrated in FIG. 14.

The lower support portion 223B, as illustrated in FIGS. 6 and 10, has an L-shape as viewed in the X direction. Specifically, the lower support portion 223B has a bottom surface extending from the flat plate 221B in the −Y direction and a side surface extending from the bottom surface in the +Z direction. As illustrated in FIG. 17, the side surface of the lower support portion 223B has a threaded hole 411 into which the screw 41 passing through the insertion hole 410 of the cover member 22A is threadably received. With the lower side surface portion 223A of the cover member 22A overlapped with the side surface of the lower support portion 223B of the cover member 22B, the threaded hole 411 receives the screw 41 that passes through the insertion hole 410 of the lower side surface portion 223A. This fastens the −Z end of the cover member 22A to the −Z end of the cover member 22B, as illustrated in FIG. 19, thereby achieving connection between the cover member 22A and the cover member 22B.

The side walls 228A and 228B of the flat plates 221A and 221B, respectively, have the restraint holes 227A and 227B for restraining the protruding claws 217A and 217B of the protective members 21A and 21B for connection between the cover member 22A and the protective member 21A and connection between the cover member 22B and the protective member 21B, as illustrated in FIG. 10. The restraint holes 227A and 227B are similarly configured. Thus the description is provided using the restraint hole 227A as an example. The restraint hole 227A, as illustrated in FIG. 12, straddles the edge between the −Y-side surface of the flat plate 221A of the cover member 22A and the −X-side end surface of the flat plate 221A. As illustrated in FIG. 20, in the state in which the cover member 22A and the protective member 21A assembled into the outdoor unit 1, the protruding claw 217A of the protective member 21A is inserted into the restraint hole 227A. The protruding claw 217A engages with the +Y-side edge of the restraint hole 227A. The cover member 22A thereby holds the protective member 21A. Here, the restraint hole 227A has a shape of a rectangle with sides extending in the Y and Z directions. The Z-direction width of the restraint hole 227A is greater than that of the protruding claw 217A. Thus the protruding claw 217A inserted in the restraint hole 227A restrains the Y-direction position of the protective member 21A. In the Z direction, however, the protective member 21A is allowed to move by a difference in size between the restraint hole 227A and the protruding claw 217A. Specifically, as illustrated in FIG. 20, the +Z end of the protruding claw 217A is separated from the +Z-side inner wall of the restraint hole 227A by a distance T, and the −Z end of the protruding claw 217A is separated from the −Z-side inner wall of the restraint hole 227A by the distance T. Thus the protruding claw 217A can move by up to twice the distance T. This allows the restraint hole 227A to accommodate deformation of the heat transfer tubes 20A by up to twice the distance T in the Z direction. For example, even when deformation of the heat transfer tubes 20A caused by contraction or expansion of the collector tube due to the ambient air temperature or the refrigerant therein moves the protective member 21A in the Z direction, the restraint hole 227A can accommodate the movement. Although not illustrated, the cover member 22B also has a restraint hole 227B that is the same as that of the cover member 22A.

The lower support portion 223B has the stop 229 on the bottom surface thereof, as illustrated in FIG. 17. The stop 229 has a projecting shape extending in the +X direction from the bottom surface of the lower support portion 223B. As illustrated in FIG. 28, the stop 229 is located in a gap between a bottom 250 of the heat exchange units 200C and 200D and a mat member 150 covering a recessed portion of a support 121 provided on the bottom panel 10E, with the cover members 22A and 22B assembled into the outdoor unit 1. This arrangement allows the stop 229 to position the cover members 22A and 22B in the Z direction within a range of the gap relative to the heat exchange units 200C and 200D. Such positioning by the stop 229 facilitates assembling of the outdoor unit 1, described later. In addition, even when the heat transfer tubes 20A deform, the stop 229 accommodates the deformation of the heat transfer tubes 20A by allowing the cover member 22B to move to a position within a range corresponding to the gap.

The flat plates 221A and 221B have threaded holes for fastening the cover members 22A and 22B to the housing 10 by screws. As illustrated in FIG. 12, the flat plate 221A has a threaded hole 420 into which the screw 43 for fastening the rear panel 10C of the housing 10 is threadably received, and an insertion hole 421 into which an end of the rear guard 14 is inserted and fastened. The flat plate 221A, as illustrated in FIG. 14, has a threaded hole 430 into which a screw 42 for fastening the bottom panel 10E of the housing 10 is threadably received. As illustrated in FIGS. 25 and 26, the flat plate 221A is fastened to the bottom panel 10E by the screw 42, with the heat exchanger 20 mounted on the bottom panel 10E. The flat plate 221A is fastened to the rear panel 10C by the screw 43, with the flat plate 221A abutting the rear panel 10C, as illustrated in FIG. 9.

Although not illustrated, the flat plate 221B has a threaded hole into which a screw 44 for fastening the separator plate 10F is threadably received. The flat plate 221B is fastened to the separator plate 10F by the screw 44, with the flat plate 221B abutting the −Y end of the separator plate 10F, as illustrated in FIG. 8.

Next, a method for assembling the outdoor unit 1 is described.

First, the heat exchanger 20, the protective members 21A and 21B, and the cover members 22A and 22B, having shapes described above, are made. Each of a set of three protective members 21A and a set of three protective members 21B is prepared for the corresponding Y-direction side surface of the single heat exchanger 20. Each of the cover members 22A and 22B is prepared for the corresponding Y-direction side surface of the single heat exchanger 20. For preparation of the heat exchanger 20, the heat transfer tubes 20A, the fins 20B, and the refrigerant tubes 20E that are made of an aluminum alloy are first assembled into the above-described arrangement and integrated together by brazing to fabricate the heat exchange units 200A to 200D. The fabricated heat exchange units 200A to 200D are then combined to produce the heat exchanger 20. The protective members 21A and 21B are made in the above-described shape and size by injection molding. Examples of materials used for injection molding include polypropylene, which is a thermoplastic resin. The cover members 22A and 22B are made by pressing an aluminum alloy plate.

Together such the preparation, the front panel 10A, the left side panel 10B, the rear panel 10C, the top panel 10D, the bottom panel 10E, and the separator plate 10F are made. Specifically, a steel plate with surface coating is pressed to make the front panel 10A, the left side panel 10B, the rear panel 10C, and the top panel 10D. A steel plate with a plated layer formed thereon is pressed to make the bottom panel 10E and the separator plate 10F.

Then, the protective members 21A and 21B are attached to the heat exchanger 20. First, the protective member 21A is disposed on the −Y side of the heat exchanger 20 and is then positioned relative to the heat transfer tubes 20A while being abutted at the positioning ribs 218 against the transfer tubes 20A. Then, the locking claws 216P and 216Q of the protective member 21A are engaged with the heat transfer tubes 20A. The positioning of the protective member 21A and the engagement of the locking claws 216P and 216Q are repeatedly performed to finish attachment of the three protective members 21A to the heat exchanger 20 on the −Y side thereof. The protective members 21B are disposed on the +Y-direction heat exchanger 20 side, and are then positioned while being abutted at the positioning ribs 218 against the heat transfer tubes 20A. Then, the locking claws 216P and 216Q of the protective members 21B are engaged with the heat transfer tubes 20A, following the above-described engagement steps of the locking claws 216P and 216Q. Similarly, the positioning of the protective members 21B and the engagement of the locking claws 216P and 216Q are repeated performed to finish attachment of the three protective members 21B to the heat exchanger 20 on the +Y side thereof.

Then, the cover members 22A and 22B are attached to the heat exchanger 20 with the protective members 21A and 21B attached. In the first step of this attachment process, the heat exchanger 20 with the protective members 21A and 21B attached is sandwiched by the cover members 22A and 22B. Then, the protruding claws 217A and 217B of the protective members 21A and 21B are inserted into the restraint holes 227A and 227B of the cover members 22A and 22B. The cover members 22A and 22B are thereby held by the protective members 21A and 21B, as illustrated in FIG. 20. Then, the locking claw 224A on the top surface portion 222A of the protective member 21A is engaged with the locking hole 224B in the protrusion 222B of the protective member 21B. Then, the screw 41 is inserted into the insertion hole 410 in the lower side surface portion 223A of the cover member 22A, and the screw 41 is then received into the threaded hole 411 in the lower support portion 223B of the cover member 22B, as illustrated in FIG. 20. This fastens the lower side surface portion 223A to the lower support portion 223B. Through the above process, the cover members 22A and 22B are attached so as to cover the protective members 21A and 21B.

Next, the heat exchanger 20 with the protective members 21A and 21B and the cover members 22A and 22B attached is mounted on the support 121 of the bottom panel 10E. The cover members 22A and 22B after being attached to the heat exchanger 20 are temporarily retained with the protruding claws 217A and 217B restrained in the restraint holes 227A and 227B. Thus the cover members 22A and 22B are not positioned relative to the protective members 21A and 21B in the Z direction illustrated in FIG. 18. To provide the Z-direction positioning, mounting the heat exchanger 20 on the support 121 of the bottom panel 10E brings the stop 229 of the cover member 22A into a space between the bottom 250 of the heat exchange units 200C and 200D and the recessed portion of the support 121, as illustrated in FIGS. 27 and 28. This positions the cover members 22A and 22B in the Z direction. Then, as illustrated in FIG. 26, the cover member 22A is fastened to the bottom panel 10E using the screw 42. The heat exchanger 20 is thereby fastened to the bottom panel 10E.

Next, components such as a compressor and a receiver are attached to the heat exchanger 20, and components such as the fan 60 and the motor 61 are installed on the bottom panel 10E. The front panel 10A, the left side panel 10B, the rear panel 10C, the top panel 10D, and the separator plate 10F are assembled together with the bottom panel 10E to construct the housing 10. Assembling of the outdoor unit 1 is completed in the above manner.

In the above-described assembling method, the protective members 21A and 21B are attached to the heat exchanger 20, and then the cover members 22A and 22B are attached to the protective members 21A and 21B. However, the cover members 22A and 22B may be attached to the protective members 21A and 21B beforehand, and then the members integrated together may be attached to the heat exchanger 20. In this case, the cover members 22A and 22B may be attached to the protective members 21A and 21B by inserting the protruding claws 217A and 217B of the protective members 21A and 21B into the restraint holes 227A and 227B of the cover members 22A and 22B.

The protective members 21A and 21B and the cover members 22A and 22B described above may be designed to have shapes and sizes as described below, in order to achieve attachment thereof to the heat exchanger 20 even when misalignment of the heat exchange units 200A to 200D occurs.

In a case in which misalignment of the protective members 21A and 21B in the X direction occurs, the flat plates 221A and 221B may have changes in the X-direction width in the Z-direction middle portion, that is, at a section of boundary between the heat exchange units 200A to 200D to achieve attachment of the cover members 22A and 22B to the heat exchanger 20. Specifically, a step may be formed on the flat plate 221A at the −X end since the flat plate 221A has on the +X end the side wall 228A, and with this step, the flat plate 221A may have an X-direction width greater on the +Z side than on the −Z side. That is, widths W1 and W2 indicated in FIG. 13 have a relation: W1<W2.

In this case, although not illustrated, the flat plate 221B may also have changes in the X-direction width in the Z-direction middle portion. Changes in the X-direction width of the flat plate 221B may be made with steps formed both the +X end and −X end since the flat plate 221B has the side walls 228B on both the +X end and the −X end. Then the steps may be provided in positions corresponding to a boundary at which the heat exchange unit 200A is adjacent to the heat exchange unit 200C or a boundary at which the heat exchange unit 200B is adjacent to the heat exchange unit 200D. This allows the cover members 22A and 22B to fully cover the protective member 21A with the cover members 22A and 22B attached to the heat exchanger 20, even when misalignment between the heat exchange units 200A and 200C or misalignment between the heat exchange units 200B and 200D occurs. Steps may be formed on the −X ends of the flat plate 221A and the flat plate 221B.

In addition, in this case, the cover member 22A may be attached to the protective member 21A so that a distance between the side wall 228A of the cover member 22A and the side wall 212A of the protective member 21A is smaller on the +Z side than on the −Z side. Similarly, the cover member 22B may be attached to the protective member 21B so that a distance between the side wall 228B of the cover member 22B and the side wall 212B of the protective member 21B is smaller on the +Z side than on the −Z side. In other words, a clearance L1 between the side wall 228A and the side wall 212A illustrated in FIG. 22 (or a clearance L1 between the side wall 228B and the side wall 212B) and a clearance L2 between the side wall 228A and the side wall 212A illustrated in FIG. 24 (or a clearance L2 between the side wall 228B and the side wall 212B) may satisfy a relationship: L1<L2. This enables the cover members 22A and 22B and the protective members 21A and 21B to accommodate misalignment due to deformation of the heat transfer tubes 20A. To illustrate the relationship between the clearances L1 and L2, the cross-sectional view of FIG. 22 illustrates a portion located more adjacent to the +Z side than a portion illustrated in the cross-sectional view of FIG. 24, as illustrated in FIGS. 18, 21, and 23.

As illustrated in FIGS. 29 and 30, the protective members 21A and 21B are shaped such that a clearance C1 between the positioning ribs 218 of the protective member 21A and 21B and the heat transfer tubes 20A is smaller than the clearance C2 between the protrusions 215A and 215B and the heat transfer tubes 20A. That is, the clearance C1 may satisfy a relationship: C1<C2. If the clearance C2 is smaller, contraction or expansion of the collector tube 31 due to the ambient temperature of the air conditioning device deforms the heat transfer tubes 20A toward the collector tube 31 side from a position P2 in the X direction illustrated in FIG. 29, which may cause high stress on the heat transfer tubes 20A. Conversely, if the clearance C2 is greater, the position from which deformation of the heat transfer tubes 20A starts is located on a position P1 in the X direction illustrated in FIG. 29. This can decrease the stress applied on the heat transfer tubes 20A.

As described above, the clearance C2 in the Z-direction middle portion of the protective members 21A and 21B may be preferably smaller than clearances C2 on both the Z-direction sides of the protective members 21A and 21B. Such arrangement of the clearances C2 enables the protective members 21A and 21B to follow heat transfer tubes 20A with an average amount of deformation among the multiple heat transfer tubes 20A covered with the protective members 21A and 21B. This results in decreased clearances C2 on both of the Z-direction sides.

As described above, in the outdoor unit 1 for the air conditioning device according to this embodiment, the −X-side end portions of the heat transfer tubes 20A and the fin 20B located on the −X-side end portion of the heat exchange units 200A and 200B are sandwiched by the flat plates 211A and 211B of the protective members 21A and 21B. The protrusions 215A and 215B of the protective members 21A and 21B each protrude in the Z direction toward a space between the heat transfer tubes 20A. Thus this can reduce entry of the outside air and rainwater through the space. As a result, the outdoor unit 1 achieves reduction of spreading of rainwater into the machine chamber 100A.

In the outdoor unit 1, the flat plates 211A and 211B of the protective members 21A and 21B are covered with the flat plates 221A and 221B of the cover members 22A and 22B. The cover member 22B in turn abuts the rear panel 10C. This reduces entry of the outside air and rainwater from between the protective member 21B and the rear panel 10C.

The separator plate 10F is fastened to the cover member 22B in abutment therewith. This reduces entry of the outside air and rainwater from between the protective member 21B and the separator plate 10F.

The flat plate 221A of the cover member 22A has the side wall 228A covering the −X-side end surface of the flat plate 211A of the protective member 21A. The flat plate 221B of the cover member 22B has the side walls 228B each covering the corresponding one of the +X-side end surface and the −X-side end surface of the flat plate 211B of the protective member 21B. The side walls 228A and 228B face these end surfaces of the flat plates 211A and 211B of the protective members 21A and 21B. This arrangement can prevent spreading of rainwater from the end surfaces of the flat plates 211A and 211B even if entry of rainwater via the flat plates 211A and 211B of the protective members 21A and 21B occurs.

The protective members 21A and 21B cover the −X-side end portions of the heat transfer tubes 20A and the fin 20B from both sides in the Y direction. The cover members 22A and 22B cover the protective members 21A and 21B from both sides in the Y direction. Even if deformation of the −X-side end portions of the heat transfer tubes 20A and the fin 20B occur, the protective members 21A and 21B deform in accordance with the deformation without correcting the deformation of the heat transfer tubes 20A and the fin 20B. The cover members 22A and 22B also deform in accordance with the shapes of the separator plate 10F and the rear panel 10C without correcting the deformation of the heat transfer tubes 20A and the fin 20B. Thus the cover members 22A and 22B and the protective members 21A and 21B are not required to have high stiffness for correction of the deformation of the heat transfer tubes 20A and the fin 20B. Thus the flat plates 221A and 221B of the cover members 22A and 22B and the flat plates 211A and 211B of the protective members 21A and 21B can be formed by a thin plate such as sheet metal or a resin sheet. This provides a further weight saving benefit to the outdoor unit 1.

The heat transfer tubes 20A are made of an aluminum alloy, and the protective members 21A and 21B are made of polypropylene. This also enables reduction of weight of the outdoor unit 1. The protective members 21A and 21B have a flexibility higher than that of the heat transfer tubes 20A, and thus even if the heat exchanger 20 deforms by warpage, the protective members 21A and 21B can deform in accordance with the deformation of the heat exchanger 20. This flexibility can reduce entry of rainwater. In addition, even if a gap is created between the protective members 21A and 21B and the cover members 22A and 22B due to deformation of the heat exchanger 20, spreading of rainwater can be prevented by the cover members 22A and 22B having the side walls 228A and 228B as described above.

The cover members 22A and 22B are made of an aluminum alloy. This also enables reduction of weight of the outdoor unit 1. The cover members 22A and 22B have a flexibility higher than that of the rear panel 10C or the separator plate 10F, and thus even if the rear panel 10C or the separator plate 10F deforms by warpage, the cover members 22A and 22B can deform in accordance with the deformation of the rear panel 10C or the separator plate 10F. This flexibility can reduce entry of rainwater. In addition, even if a gap is created between the protective members 21A and 21B and the cover members 22A and 22B due to deformation of the rear panel 10C or the separator plate 10F, spreading of rainwater can be prevented by the cover members 22A and 22B having the side walls 228A and 228B as described above.

Embodiment 2

An outdoor unit for an air conditioning device according to Embodiment 2, is an outdoor unit with a protective member having air vents through which air passes. The configuration of the outdoor unit for the air conditioning device according to Embodiment 2 is described below with reference to FIGS. 31 to 33. Embodiment 2 is described in terms of structural differences from Embodiment 1.

Figure 31:
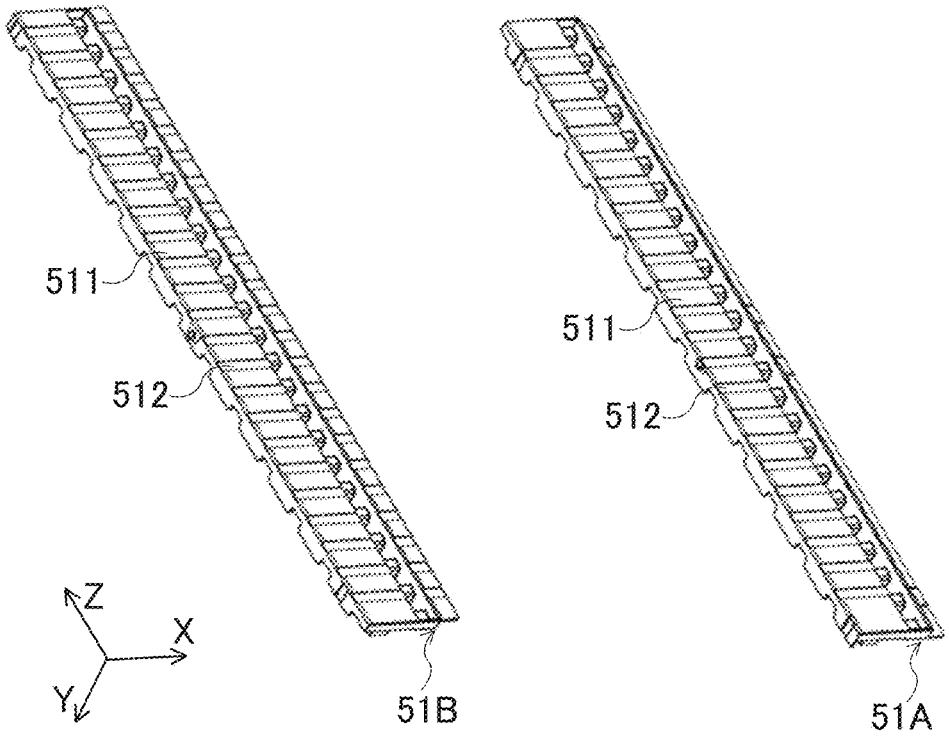
FIG. 31 is a perspective view of protective members of an outdoor unit for an air conditioning device according to Embodiment 2.

FIG. 31 is a perspective view of protective members of the outdoor unit for the air conditioning device according to Embodiment 2. As illustrated in FIG. 31, protective members 51A and 51B have rectangular flat plates 511 extending in the Z direction. Each flat plate 511 has, on the −Y side thereof, groove-shaped air vents 512 extending in the X direction. The depth, that is, the Y-direction size, of the groove of each air vent 512 is smaller than the wall height, that is, the Y-direction size, of each of the side walls 228A and 228B of the cover members 22A and 22B.

Figure 32:
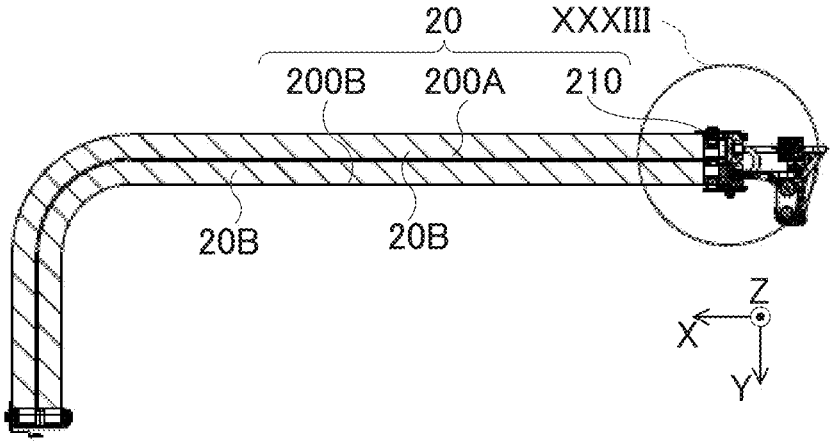
FIG. 32 is a cross-sectional view of a heat exchanger with the protective members and cover members attached.
Figure 33:
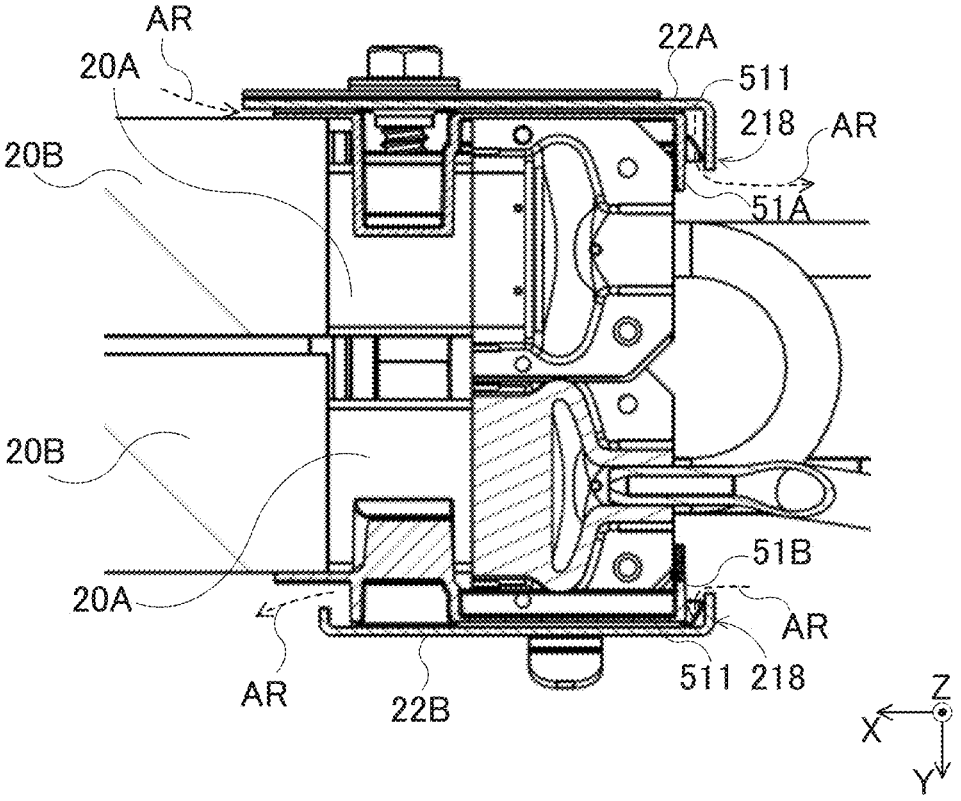
FIG. 33 is an enlarged view of a portion XXXIII of FIG. 32.

FIG. 32 is a cross-sectional view of a heat exchanger with protective members and cover members attached. FIG. 33 is an enlarged view of a portion XXXIII of FIG. 32.

As illustrated in FIG. 33, air passes through from the fan chamber 100B through the air vents 512 to the machine chamber 100A, following the path indicated by arrows AR. The air vents 512 have a Y-direction size smaller than that of the side walls 228A and 228B. Thus the side walls 228A and 228B function as blockers even if air entrains rainwater. This helps reduce spreading of rainwater into the machine chamber 100A, which results in protection of electrical components inside the machine chamber 100A from rainwater.

Some embodiments of the present disclosure are described above, but the present disclosure is not limited to the above-described embodiments. For example, three protective members 21A are used for a single cover member 22A in Embodiments 1 and 2, and three protective members 21B are used for a single cover member 22B. However, the present disclosure is not limited to such configuration. According to the present disclosure, it is sufficient that a first cover member covers a first flat plate of a first protective member, and a second cover member covers a second flat plate of a second protective member. In this case, it is sufficient the first cover member, together with the second cover member, sandwich the first flat plate of the first protective member and the second flat plate of the second protective member therebetween. Here, in Embodiments 1 and 2, the cover members 22A and 22B correspond to the first cover member and the second cover member of the present disclosure, respectively. The protective members 21A and 21B correspond to the first protective member and the second protective member, respectively. The flat plates 211A and 211B correspond to the first flat plate and the second flat plate, respectively.

Thus, it is sufficient that the outdoor unit 1 includes at least one cover member 22A and at least one cover member 22B. It is also sufficient that the outdoor unit 1 includes at least one protective member 21A and at least one protective member 21B. For example, the outdoor unit 1 may include a single cover member 22A and a single cover member 22B, and at least four protective members 21A and at least four protective members 21B.

Figure 34:
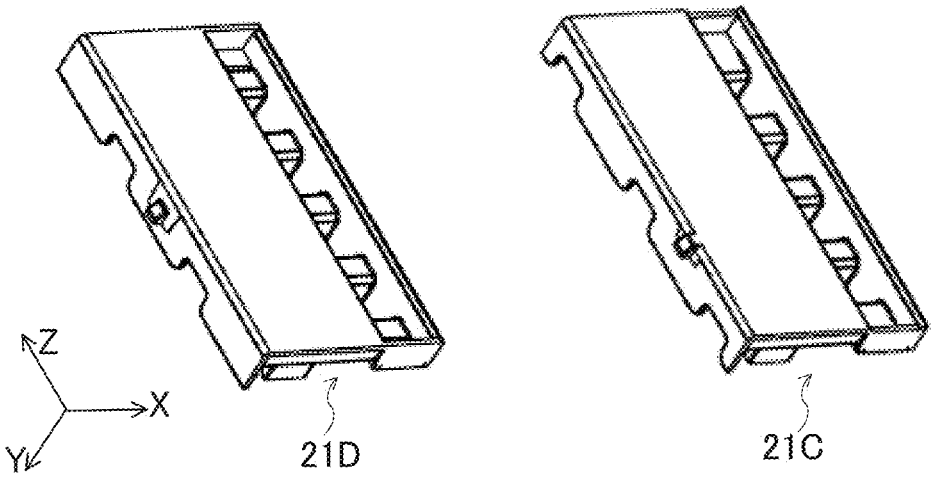
FIG. 34 is a perspective view of a variation of the protective members.
Figure 35:
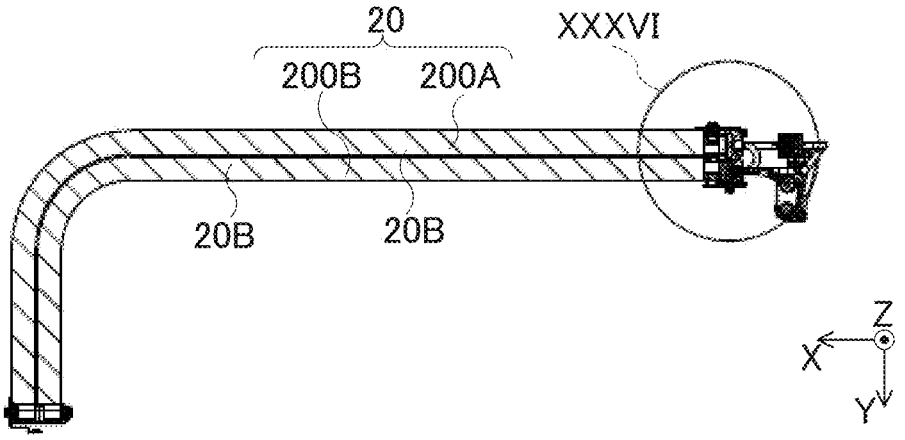
FIG. 35 is a cross-sectional view of the heat exchanger with the protective members according to the variation and the cover members attached.
Figure 36:
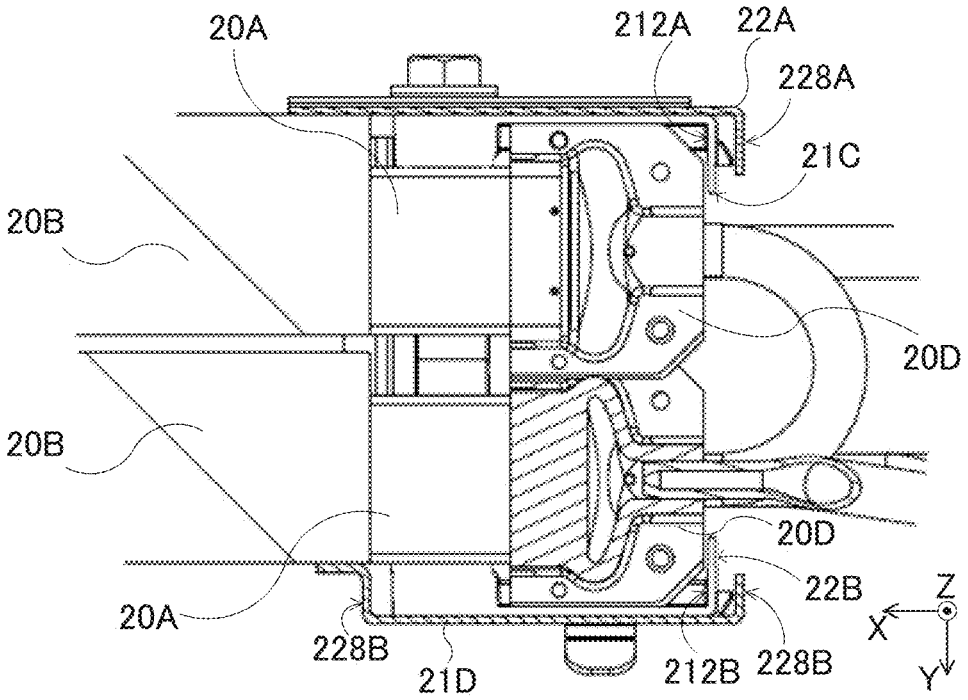
FIG. 36 is an enlarged view of a portion XXXVI of FIG. 35.

FIG. 34 is a perspective view of a variation of the protective members. FIG. 35 is a cross-sectional view of the heat exchanger with the protective members according to the variation and the cover members attached. FIG. 36 is an enlarged view of a portion XXXVI of FIG. 35.

Protective members 21C and 21D illustrated in FIG. 34 have a Z-direction length that is approximately one fourth of that of the protective members 21A and 21B. In this case, twelve protective members 21C are used for the single cover member 22A, and twelve protective members 21D are used for the single cover member 22B. As illustrated in FIGS. 35 and 36, the outdoor unit 1 that adopts the protective members 21C and 21D can also achieve reduction of entry of the outside air and rainwater by covering of the spaces between the heat transfer tubes 20A with the protective members 21C and 21D. As indicated, the number of the protective members 21A to 21D may be changed in accordance with the sizes of the cover members 22A and 22B and heat transfer tubes 20A.

The protective members 21C and 21D may partially cover the heat transfer tubes 20A of the heat exchanger 20. This decreases the effect of reducing entry of the outside air and rainwater. However, this can provide protection of the heat transfer tubes 20A against the screw 43 for fastening the cover member 22A, by the protective members 21C and 21D covering only the heat transfer tubes 20A located near a place in which the cover member 22A is fastened by screws.

In Embodiments 1 and 2, the heat transfer tubes 20A are flat tubes, but the present disclosure is not limited to such configuration. The heat transfer tubes 20A of the present disclosure may have any shape as long as one end of each heat transfer tube 20A has a shape to allow connection to the refrigerant tube 20E to achieve heat exchange. For example, the heat transfer tubes 20A may be cylindrical tubes. Alternatively, the heat transfer tubes 20A may include a flat tube and a cylindrical tube. However, use of flat tubes as heat transfer tubes 20A is desired since the flat tubes contributes to reduction in size and weight of the outdoor unit 1.

According to the present disclosure, it is sufficient that the heat transfer tube 20A is connected at one end thereof to the refrigerant tube to allow flow of refrigerant. Thus inclusion of the collector tube is optional. The term "refrigerant tube" refers to a tube for passing refrigerant and also includes a tube that is referred to as a connection tube. Examples of components for use of connection to the refrigerant tube include, in addition to the coupling 20D, a component that is referred to as a connection member.

In Embodiments 1 and 2, the heat transfer tubes 20A are connected through the couplings 20D and the refrigerant tubes 20E to the collector tube 31. However, the present disclosure is not limited to such configuration. According to the present disclosure, the heat transfer tubes 20A may be connected directly to the collector tube.

In Embodiments 1 and 2, the fins 20B have a flat rectangular shape. In addition, fin 20B portions adjacent to each other in the Z direction are connected to each other to form an integral component. However, the present disclosure is not limited to such configuration. According to the present disclosure, it is sufficient that the fins 20B extend from the heat transfer tubes 20A. In addition, with the heat transfer tubes 20A arranged with a space provided therebetween, the fins 20B preferably extend toward the spaces. Thus fin 20B portions are each formed separately for the adjacent heat transfer tubes 20A in the Z direction. Cuts may be formed in the fins 20B or the fins 20B may be made bent.

In Embodiments 1 and 2, the heat exchanger 20 includes the multiple heat transfer tubes 20A, but the present disclosure is not limited to such configuration. According to the present disclosure, it is sufficient that the heat exchanger 20 includes two or more heat transfer tubes 20A and the two or more heat transfer tubes 20A are arranged with a space provided therebetween.

In Embodiments 1 and 2, the heat exchanger 20 includes heat exchange units 200A to 200D, but the present disclosure is not limited to such configuration. According to the present disclosure, it is sufficient that the heat exchanger 20 includes heat transfer tubes 20A and fins 20B extending from the heat transfer tubes 20A. Thus the number of the heat exchange units 200A to 200D is not limited to such configuration. In addition, the heat exchanger 20 not including a component that is referred to as the heat exchange units 200A to 200D may also be possible as long as the heat exchanger 20 has the heat transfer tubes 20A and the fins 20B.

According to the present disclosure, it is sufficient that when the heat exchanger includes the heat exchange units, the first heat exchange unit and the second heat exchange unit are located adjacent to each other, and one-end portions of the heat transfer tubes 20A and a fin 20B of the fins 20B that is located on the one-end portion side of the heat transfer tubes 20A of the first heat exchange unit are covered with a first flat plate (that is, flat plate 211A). Similarly, one-end portions of the heat transfer tubes 20A and a fin 20B of the fins 20B that is located nearest the one-end portion side of the second heat exchange unit are covered with a second flat plate (that is, the flat plate 211B) at the opposite side of the second heat exchange unit side adjacent to the first heat exchange unit. In this case, the first heat exchange unit may be located directly or indirectly adjacent to the second heat exchange unit. For example, the first heat exchange unit and the second heat exchange unit may be located adjacent to each other via another heat exchange unit. In Embodiments 1 and 2, the heat exchange unit 200A corresponds to the first heat exchange unit of the present disclosure and the heat exchange unit 200B corresponds to the second heat exchange unit of the present disclosure.

Figure 37:
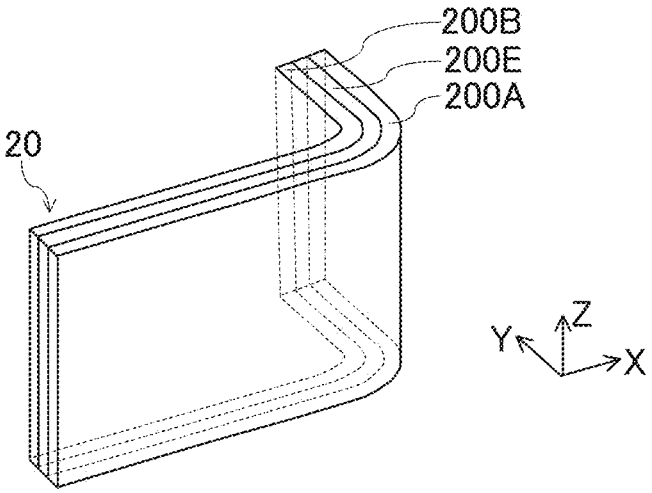
FIG. 37 is a perspective view illustrating a variation of the heat exchanger.

FIG. 37 is a perspective view illustrating a variation of the heat exchanger. In FIG. 37, tubes such as the heat transfer tubes 20A and the refrigerant tubes 20E are not illustrated.

As illustrated in FIG. 37, another heat exchange unit 200E is sandwiched between the heat exchange unit 200A and the heat exchange unit 200B. In this way, the heat exchange unit 200A may be indirectly adjacent to the heat exchange unit 200B. The heat exchanger 20 of FIG. 37 is constructed by only a single stage of heat exchange units that corresponds to the upper part described in Embodiment 1. Thus the heat exchanger of the present disclosure may be constructed by a single stage of heat exchange units such as the heat exchange units 200A and 200B or by multiple stages of heat exchange units. In addition, the heat exchanger 20 may be a single heat exchange unit 200A.

In Embodiments 1 and 2, the housing 10 contains the machine chamber 100A, and the machine chamber 100A contains electrical components and electric circuits. However, the present disclosure is not limited to such configuration. According to the present disclosure, it is sufficient that the electrical components that operate by power are contained in the machine chamber 100A. For example, the machine chamber 100A may contain an electric circuit for the fan 60. The machine chamber 100A may also contain electric circuits for various types of sensors.

In Embodiments 1 and 2, the protective members 21A and 21B are made of polypropylene. The cover members 22A and 22B are made of an aluminum alloy. However, the present disclosure is not limited to such configuration. According to the present disclosure, it is sufficient that the protective member 21A, that is, the first protective member has (i) a first flat plate that covers one-end portions of the heat transfer tubes 20A and an endmost fin 20B of the fins 20B that is located nearest the one-end portion side of the heat transfer tubes 20A, and (ii) first protrusions that protrude from the first flat plates toward spaces on the one-end portion side of the heat transfer tubes 20A. It is also sufficient that the protective member 21B, that is, the second protective member has (i) a second flat plate that sandwiches, together with the first flat plate, the one-end portions of the heat transfer tubes 20A and the endmost fin 20B, and (ii) second protrusions that protrude from the second flat plate toward spaces on the one-end portion side. The protective members 21A and 21B may be made of any material as long as such a configuration is obtained. Here, in Embodiments 1 and 2, the flat plates 211A and 211B correspond to the first flat plate and the second flat plate of the present disclosure, and the protrusions 215A and 215B correspond to the first protrusion and the second protrusion of the present disclosure.

Thus the protective members 21A and 21B may be made with metals other than an aluminum alloy, resins other than polypropylene, or the like. The protective members 21A and 21B may be advantageously made of a resin material to achieve reduction in size and weight of the outdoor unit 1. The cover members 22A and 22B may be advantageously made of an aluminum alloy. With such materials, the resin protective members 21A and 21B can prevent electrolytic corrosion of the cover members 22A and 22B.

In Embodiments 1 and 2, the protective members 21A and 21B cover the most-negative-X-side fin 20B, that is, the endmost fin 20B on the −X side. However, the present disclosure is not limited to such configuration. According to the present disclosure, as described above, it is sufficient that the flat plate 211A, that is, the first flat plate covers the one-end portions of the heat transfer tubes 20A and the endmost fin 20B of the fins 20B that is located near the one-end portions of the heat transfer tubes 20A. In addition, it is sufficient that the flat plate 211B, that is, the second flat plate, together with the first flat plate, sandwich the one-end portions of the heat transfer tubes 20A and the endmost fin 20B therebetween. Of course, the first flat plate may cover a fin 20B next to the endmost fin 20B in addition to the endmost fin 20B located near the one-end portions of the heat transfer tubes 20A as long as the first flat plate covers the endmost fin 20B of the fins 20B that is located near the one-end portions of the heat transfer tubes 20A. It is sufficient that the first flat plate covers at least the endmost fin 20B of the fins 20B that is located near the one-end portions of the heat transfer tubes 20A. The second flat plate, together with the first flat plate, sandwich the endmost fin 20B located near the one-end portions of the heat transfer tubes 20A as well as a fin 20B next to the endmost fin 20B. It is sufficient that the second flat plate, together with the first flat plate, sandwiches at least the endmost fin 20B of the fins 20B that is located near the one-end portions of the heat transfer tubes 20A.

It is sufficient that the cover members 22A and 22B are disposed to sandwich the first flat plate and the second flat plate therebetween to cover the first flat plate and the second flat plate and the cover members 22A and 22B are fastened to the separator plate 10F. The cover members 22A and 22B may be made of any material as long as such a configuration is obtained. For example, the cover members 22A and 22B may be made with resins other than polypropylene, metals other than an aluminum alloy, or the like. The cover members 22A and 22B contribute to reduction of breakage and wear of the heat transfer tubes 20A, and thus the cover members 22A and 22B are advantageously made of a material with stiffness lower than that of the heat transfer tubes 20A. When the cover members 22A and 22B are formed of a metal material, an anti-corrosive layer is advantageously formed on the cover members 22A and 22B to prevent electrolytic corrosion.

In Embodiments 1 and 2, the housing 10 is separated by the separator plate 10F into the machine chamber 100A and the fan chamber 100B. However, the present disclosure is not limited to such configuration. According to the present disclosure, the housing 10 may have a separator member that separates the housing 10 into multiple spaces. In this case, the separator member may be, for example, a film-like member or a cloth-like member.

In Embodiments 1 and 2, the flat plate 221A of the cover member 22A has an inverted L-shape in the XY cross section. The flat plate 221B of the cover member 22B has a U-shape in the XY cross section. However, the present disclosure is not limited to such configuration. According to the present disclosure, it is sufficient that when the flat plates 221A and 221B have walls (specifically, the side walls 228A and 228B), the side walls 228A and 228B face the end portions of the flat plates 211A and 211B of the protective members 21A and 21B at the −X ends of the heat transfer tubes 20A, that is, at end portions, located near the machine chamber 100A, of the heat transfer tubes 20A. This configuration can reduce spreading of rainwater having reached the −X end of the flat plates 211A and 211B into the machine chamber 100A. Thus, according to the present disclosure, the flat plates 221A and 221B having side walls 228A and 228B only on the −X-end side are also possible. In other words, the flat plates 221A and 221B may both have an L-shape in the XY cross section.

According to the present disclosure, the first flat plate and the second flat plate may have a first locking claw and a second locking claw that engage with the heat transfer tubes. The first flat plate and the second flat plate may have a first air vent and a second air vent. Here, in Embodiments 1 and 2, the locking claws 216P and 216Q correspond to the first locking claw and the second locking claw of the present disclosure, and the air vents 512 of the protective member 51A and the protective member 51B correspond to the first air vent and the second air vent of the present disclosure.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

This application claims the benefit of Japanese patent Application No. 2016-203656, filed on Oct. 17, 2016, the entire disclosure of which is incorporated by reference herein.

REFERENCE SIGNS LIST

1 Outdoor unit
10 Housing
10A Front panel
10B Left side panel
10C Rear panel
10D Top panel
10E Bottom panel
10F Separator plate
11 Air discharge vent
12A, 12B Air inlet
13 Fan guard
14 Rear guard
20 Heat exchanger
20A Heat transfer tube
20B Fin
20C Space
20D Coupling

20E Refrigerant tube
21A to 21D Protective member
22A, 22B Cover member
31 Collector tube
41 to 44 Screw
51A, 51B Protective member
60 Fan
61 Motor
62 Fan frame
100A Machine chamber
100B Fan chamber
101 First front panel section
102 Second front panel section
103 Third front panel section
111 First rear panel section
112 Second rear panel section
121 Support
150 Mat member
200A to 200E Heat exchange unit
211A, 211B Flat plate
212A, 212B Side wall
213A, 213B Rib
215A, 215B Protrusion
216P, 216Q Locking claw
217A, 217B Protruding claw
218 Positioning rib
221A, 221B Flat plate
222A Top surface portion
222B Protrusion
223A Lower side surface portion
223B Lower support portion
224A Locking claw
224B Locking hole
227A, 227B Restraint hole
228A, 228B Side wall
229 Stop
250 Bottom
410, 421 Insertion hole
411, 420, 430 Threaded hole
511 Flat plate
512 Air vent
C1, C2 Clearance
W1, W2 Width
L1, L2 Clearance
AR Arrow
P1, P2 Position
S Space
T Distance

The invention claimed is:

1. An outdoor unit for an air conditioning device, the outdoor unit comprising:

a heat exchanger including (i) heat transfer tubes arranged with a space provided between the heat transfer tubes and each having one end connected to a refrigerant tube to transfer heat of refrigerant contained in the refrigerant tube, and (ii) fins extending from the heat transfer tubes to exchange heat between the heat transfer tubes and outside air;

a first protective member having (i) a first flat plate that covers one-end portions of the heat transfer tubes and an endmost fin of the fins that is located nearest the one-end portions of the heat transfer tubes, and (ii) a first protrusion that protrudes from the first flat plate toward the space between the heat transfer tubes near the one-end portions of the heat transfer tubes;

a second protective member having (i) a second flat plate that covers one-end portions of the heat transfer tubes and the endmost fin oppositely from the first flat plate, and (ii) a second protrusion that protrudes from the second flat plate toward the space near the one-end portions of the heat transfer tubes;

a first cover member that covers the first flat plate;

a second cover member that covers the second flat plate; and a housing that houses the heat exchanger, the first protective member, the second protective member, the first cover member, and the second cover member, and that has an inner wall abutting the first cover member and an inner wall abutting the second cover member.

2. The outdoor unit according to claim 1, wherein the heat exchanger further includes a first heat exchange unit including a first set of heat transfer tubes of the heat transfer tubes and a first set of fins of the fins, the first set of fins extending from the first set of heat transfer tubes, and a second heat exchange unit including a second set of heat transfer tubes of the heat transfer tubes and a second set of fins of the fins, the second set of fins extending from the second set of heat transfer tubes, the second heat exchange unit being connected via the refrigerant tube to the first heat exchange unit, the first flat plate covers one-end portions of the first set of heat transfer tubes and the endmost fin of the first heat exchange unit, the second heat exchange unit is located adjacent to the first heat exchange unit oppositely from a first heat exchange unit side covered with the first flat plate, and the second flat plate covers one-end portions of the second set of heat transfer tubes and the endmost fin of the second heat exchange unit oppositely from a second heat exchange unit side that is adjacent to the first heat exchange unit, and the first heat exchange unit and the second heat exchange unit are sandwiched between the first flat plate and the second flat plate.

3. The outdoor unit according to claim 1, further comprising:

a separator member that partitions the housing into a fan chamber containing a fan and a machine chamber containing electrical components, wherein the heat transfer tubes included in the heat exchanger have a first section near the one-end portions and a second section, and the first section is disposed in the machine chamber and the second section is disposed in the fan chamber.

4. The outdoor unit according to claim 1, wherein the heat transfer tubes are disposed extending in parallel to each other.

5. The outdoor unit according to claim 4, wherein each of the first flat plate and the second flat plate has a rectangular shape and abuts surrounding portions of the heat transfer tubes, and a longitudinal direction of each of the first flat plate and the second flat plate is perpendicular to a direction in which the heat transfer tubes extend.

6. The outdoor unit according to claim 5, wherein the first flat plate has, at a middle portion and both end portions in the longitudinal direction, first locking claws that engage with the heat transfer tubes, and the second flat plate has, at a middle portion and both end portions in the longitudinal direction, second locking claws that engage with the heat transfer tubes.

7. The outdoor unit according to claim 5, wherein the first protrusion is smaller than the space, and a clearance exists between (i) a side surface of the first protrusion protruding toward the space near the one-end portions of the heat transfer tubes and (ii) the corresponding heat transfer tube, and the second protrusion is smaller than the space, and a clearance exists between (i) a side surface of the second protrusion protruding toward the space near the one-end portions of the heat transfer tubes and (ii) the corresponding heat transfer tube.

8. The outdoor unit according to claim 7, wherein among the clearances that each exist between the side surface of the first protrusion and the corresponding heat transfer tube, a clearance located in the middle portion in the longitudinal direction is smaller than a clearance located on each of both end portions in the longitudinal direction, and among the clearances that each exist between the side surface of the second protrusion and the corresponding heat transfer tube, a clearance located in the middle portion in the longitudinal direction is smaller than a clearance located on each of both end portions in the longitudinal direction.

9. The outdoor unit according to claim 1, wherein either one of the first cover member and the second cover member has a stop that restrains a position of the one of the first cover member and the second cover member relative to the heat exchanger.

10. The outdoor unit according to claim 3, wherein the first flat plate has a first air vent near the first cover member, the first air vent communicating between the fan chamber and the machine chamber, the second flat plate has a second air vent near the second cover member, the second air vent communicating between the fan chamber and the machine chamber, the first cover member has a wall portion facing an opening of the first air vent, and the second cover member has a wall portion facing an opening of the second air vent.

11. The outdoor unit according to claim 1, wherein the first protective member and the second protective member are made of a material having more flexibility than a material of the heat transfer tubes and the fins.

12. The outdoor unit according to claim 1, wherein the first protective member and the second protective member are made of a resin material, and the first cover member and the second cover member are made of an aluminum alloy.

* * * * *